US011154881B2

(12) United States Patent
Walker et al.

(10) Patent No.: US 11,154,881 B2
(45) **Date of Patent: *Oct. 26, 2021**

(54) ROTARY NOZZLE

(71) Applicant: RAIN BIRD CORPORATION, Azusa, CA (US)

(72) Inventors: Samuel C. Walker, Green Valley, AZ (US); Lee James Shadbolt, Tucson, AZ (US); David Eugene Robertson, Glendora, CA (US)

(73) Assignee: RAIN BIRD CORPORATION, Azusa, CA (US)

( * ) Notice: Subject to any disclaimer, the term of this patent is extended or adjusted under 35 U.S.C. 154(b) by 142 days.

This patent is subject to a terminal disclaimer.

(21) Appl. No.: 16/413,005

(22) Filed: May 15, 2019

(65) Prior Publication Data

US 2019/0283052 A1 Sep. 19, 2019

Related U.S. Application Data

(63) Continuation of application No. 15/359,286, filed on Nov. 22, 2016, now Pat. No. 10,322,423.

(51) Int. Cl.
*B05B 3/04* (2006.01)
*B05B 1/30* (2006.01)
(Continued)

(52) U.S. Cl.
CPC ..... *B05B 3/0486* (2013.01); *B05B 1/304* (2013.01); *B05B 3/003* (2013.01); *B05B 3/005* (2013.01);
(Continued)

(58) Field of Classification Search
CPC ..... B05B 1/304; B05B 3/003; B05B 3/005; B05B 3/0477; B05B 3/0481; B05B 3/0486; B05B 15/70; B05B 15/74
See application file for complete search history.

(56) References Cited

U.S. PATENT DOCUMENTS 458,607 A 9/1891 Weiss
1,286,333 A 12/1918 Johnson
(Continued)

FOREIGN PATENT DOCUMENTS

AU 783999 1/2006
CA 2427450 6/2004
(Continued)

OTHER PUBLICATIONS

Advisory Action dated Jul. 14, 2011 for U.S. Appl. No. 11/947,571 (3 pgs.).
(Continued)

*Primary Examiner* — Darren W Gorman
(74) *Attorney, Agent, or Firm* — Fitch, Even, Tabin & Flannery LLP

(57) ABSTRACT

An irrigation nozzle with a rotating deflector is provided whose rotational speed may be controlled by a friction brake. The nozzle may also include an arc adjustment valve having two portions that helically engage each other to define an opening that may be adjusted at the top of the sprinkler to a desired arcuate length. The arcuate length may be adjusted by pressing down and rotating a deflector to directly actuate the valve. The nozzle may also include a radius reduction valve that may be adjusted by actuation of an outer wall of the nozzle. Rotation of the outer wall causes a flow control member to move axially to or away from an inlet.

18 Claims, 15 Drawing Sheets

(51) Int. Cl.
*B05B 3/00* (2006.01)
*B05B 15/74* (2018.01)
*B05B 15/70* (2018.01)

(52) U.S. Cl.
CPC ..... *B05B 3/0477* (2013.01); *B05B 3/0481* (2013.01); *B05B 15/70* (2018.02); *B05B 15/74* (2018.02)

(56) References Cited

U.S. PATENT DOCUMENTS 1,432,386 A 10/1922 Ctjkwey
1,523,609 A 1/1925 Roach
2,075,589 A 3/1937 Munz
2,125,863 A 8/1938 Arbogast
2,125,978 A 8/1938 Arbogast
2,128,552 A 8/1938 Rader
2,130,810 A 9/1938 Munz
2,325,280 A 7/1943 Scherrer
2,348,776 A 5/1944 Bentley
2,634,163 A 4/1953 Double
2,723,879 A 11/1955 Martin
2,785,013 A 3/1957 Stearns
2,875,783 A 3/1959 Joah
2,914,257 A 11/1959 Wiant
2,935,266 A 5/1960 Geraldo
2,990,123 A 6/1961 Hyde
2,990,128 A 6/1961 Erling
3,005,593 A 10/1961 Smith
3,029,030 A 4/1962 Dey, Sr.
3,030,032 A 4/1962 Juhman, Jr.
3,109,591 A 11/1963 Moen
3,239,149 A 3/1966 Lindberg, Jr.
3,380,659 A 4/1968 Seablom
3,386,662 A 6/1968 Kennedy
3,752,403 A 8/1973 Van
3,854,664 A 12/1974 Hunter
3,955,764 A 5/1976 Phaup
3,979,066 A 9/1976 Bennie
4,026,471 A 5/1977 Hunter
4,067,497 A 1/1978 Gail
4,099,675 A 7/1978 Wohler
4,119,275 A 10/1978 Hunter
4,121,769 A 10/1978 Mordeki
4,131,234 A 12/1978 Pescetto
4,189,099 A 2/1980 Bruninga
4,198,000 A 4/1980 Hunter
4,253,608 A 3/1981 Hunter
4,272,024 A 6/1981 Kah
4,316,579 A 2/1982 Ray
4,353,506 A 10/1982 Hayes
4,353,507 A 10/1982 Kah
4,398,666 A 8/1983 Hunter
4,417,691 A 11/1983 Lockwood
4,456,181 A 6/1984 Burnham
4,471,908 A 9/1984 Hunter
4,479,611 A 10/1984 Galvis
4,501,391 A 2/1985 Hunter
4,566,632 A 1/1986 Sesser
4,568,024 A 2/1986 Hunter
4,579,284 A 4/1986 Arnold
4,579,285 A 4/1986 Hunter
4,609,146 A 9/1986 Walto
4,618,100 A 10/1986 White
4,624,412 A 11/1986 Hunter
4,625,917 A 12/1986 Torney
RE32,386 E 3/1987 Hunter
4,660,766 A 4/1987 Nelson
4,669,663 A 6/1987 Meyer
4,676,438 A 6/1987 Sesser
4,681,260 A 7/1987 Cochran
4,681,263 A 7/1987 Cockman
4,682,732 A 7/1987 Walto
4,699,321 A 10/1987 Bivens
4,708,291 A 11/1987 Grundy
4,711,399 A 12/1987 Rosenberg
4,718,605 A 1/1988 Hunter
4,720,045 A 1/1988 Meyer
4,739,394 A 4/1988 Oda
4,739,934 A 4/1988 Gewelber
D296,464 S 6/1988 Marmol
4,752,031 A 6/1988 Merrick
4,760,958 A 8/1988 Greenberg
4,763,838 A 8/1988 Holcomb
4,783,004 A 11/1988 Lockwood
4,784,325 A 11/1988 Walker
4,796,809 A 1/1989 Hunter
4,796,811 A 1/1989 Davisson
4,815,662 A 3/1989 Hunter
4,834,289 A 5/1989 Hunter
4,836,449 A 6/1989 Hunter
4,836,450 A 6/1989 Hunter
4,840,312 A 6/1989 Tyler
4,842,201 A 6/1989 Hunter
4,867,378 A 9/1989 Kah
4,898,332 A 2/1990 Hunter
4,901,924 A 2/1990 Kah
4,932,590 A 6/1990 Hunter
4,944,456 A 7/1990 Zakai
4,948,052 A 8/1990 Hunter
4,955,542 A 9/1990 Kah
4,957,240 A 9/1990 Rosenberg
4,961,534 A 10/1990 Tyler
4,967,961 A 11/1990 Hunter
4,971,250 A 11/1990 Hunter
4,971,256 A 11/1990 Malcolm
D312,865 S 12/1990 Davisson
4,986,474 A 1/1991 Schisler
5,009,368 A 4/1991 Streck
5,031,840 A 7/1991 Grundy
5,050,800 A 9/1991 Lamar
5,052,621 A 10/1991 Katzer
5,058,806 A 10/1991 Rupar
5,078,321 A 1/1992 Davis
5,083,709 A 1/1992 Iwanowski
RE33,823 E 2/1992 Nelson
5,086,977 A 2/1992 Kah
5,090,619 A 2/1992 Barthold
5,098,021 A 3/1992 Kah
5,104,045 A 4/1992 Kah
5,123,597 A 6/1992 Bendall
5,141,024 A 8/1992 Hicks
5,148,990 A 9/1992 Kah
5,148,991 A 9/1992 Kah
5,152,458 A 10/1992 Curtis
5,158,232 A 10/1992 Tyler
5,174,501 A 12/1992 Hadar
5,199,646 A 4/1993 Kah
5,205,491 A 4/1993 Hadar
5,224,653 A 7/1993 Nelson
5,226,599 A 7/1993 Lindermeir
5,226,602 A 7/1993 Cochran
5,234,169 A 8/1993 McKenzie
5,240,182 A 8/1993 Lemme
5,240,184 A 8/1993 Lawson
5,267,689 A 12/1993 Forer
5,288,022 A 2/1994 Sesser
5,297,737 A 3/1994 Davisson
5,299,742 A 4/1994 Han
5,307,993 A 5/1994 Simonetti
5,322,223 A 6/1994 Hadar
5,335,857 A 8/1994 Hagon
5,360,167 A 11/1994 Grundy
5,370,311 A 12/1994 Chen
5,372,307 A 12/1994 Sesser
5,375,768 A 12/1994 Clark
5,377,914 A 1/1995 Christen
5,398,872 A 3/1995 Joubran
5,415,348 A 5/1995 Nelson
5,417,370 A 5/1995 Kah
5,423,486 A 6/1995 Hunter
5,435,490 A 7/1995 Machut
5,439,174 A 8/1995 Sweet
RE35,037 E 9/1995 Kah

(56) References Cited

U.S. PATENT DOCUMENTS

| | | | |
|---|---|---|---|
| 5,456,411 | A | 10/1995 | Scott |
| 5,503,139 | A | 4/1996 | McMahon |
| 5,526,982 | A | 6/1996 | McKenzie |
| 5,544,814 | A | 8/1996 | Spenser |
| 5,556,036 | A | 9/1996 | Chase |
| 5,588,594 | A | 12/1996 | Kah |
| 5,588,595 | A | 12/1996 | Sweet |
| 5,598,977 | A | 2/1997 | Lemme |
| 5,611,488 | A | 3/1997 | Frolich |
| 5,620,141 | A | 4/1997 | Chiang |
| 5,640,983 | A | 6/1997 | Sherman |
| 5,642,861 | A | 7/1997 | Ogi |
| 5,653,390 | A | 8/1997 | Kah |
| 5,662,545 | A | 9/1997 | Zimmerman |
| 5,669,449 | A | 9/1997 | Polan |
| 5,671,885 | A | 9/1997 | Davisson |
| 5,671,886 | A | 9/1997 | Sesser |
| 5,676,315 | A | 10/1997 | Han |
| D388,502 | S | 12/1997 | Kah |
| 5,695,123 | A | 12/1997 | Le |
| 5,699,962 | A | 12/1997 | Scott |
| 5,711,486 | A | 1/1998 | Clark |
| 5,718,381 | A | 2/1998 | Katzer |
| 5,720,435 | A | 2/1998 | Hunter |
| 5,722,593 | A | 3/1998 | McKenzie |
| 5,758,827 | A | 6/1998 | Le |
| 5,762,270 | A | 6/1998 | Kearby |
| 5,765,757 | A | 6/1998 | Bendall |
| 5,765,760 | A | 6/1998 | Kuo |
| 5,769,322 | A | 6/1998 | Smith |
| 5,785,248 | A | 7/1998 | Staylor |
| 5,820,029 | A | 10/1998 | Marans |
| 5,823,439 | A | 10/1998 | Hunter |
| 5,823,440 | A | 10/1998 | Clark |
| 5,826,797 | A | 10/1998 | Kah |
| 5,845,849 | A | 12/1998 | Mitzlaff |
| 5,875,969 | A | 3/1999 | Grundy |
| 5,918,812 | A | 7/1999 | Beutler |
| 5,927,607 | A | 7/1999 | Scott |
| 5,971,297 | A | 10/1999 | Sesser |
| 5,988,523 | A | 11/1999 | Scott |
| 5,992,760 | A | 11/1999 | Kearby |
| 6,007,001 | A | 12/1999 | Hilton |
| 6,019,295 | A | 2/2000 | McKenzie |
| 6,029,907 | A | 2/2000 | McKenzie |
| 6,042,021 | A | 3/2000 | Clark |
| 6,050,502 | A | 4/2000 | Clark |
| 6,059,044 | A | 5/2000 | Fischer |
| 6,076,744 | A | 6/2000 | O'Brien |
| 6,076,747 | A | 6/2000 | Ming-Yuan |
| 6,085,995 | A | 7/2000 | Kah |
| 6,092,739 | A | 7/2000 | Clearman |
| 6,102,308 | A | 8/2000 | Steingass |
| 6,109,545 | A | 8/2000 | Kah |
| 6,135,364 | A | 10/2000 | Nickish |
| 6,138,924 | A | 10/2000 | Hunter |
| 6,142,386 | A | 11/2000 | Spenser |
| 6,145,758 | A | 11/2000 | Ogi |
| 6,155,493 | A | 12/2000 | Kearby |
| 6,158,675 | A | 12/2000 | Ogi |
| 6,182,909 | B1 | 2/2001 | Kah |
| 6,186,413 | B1 | 2/2001 | Lawson |
| 6,223,999 | B1 | 5/2001 | Lemelshtrich |
| 6,227,455 | B1 | 5/2001 | Scott |
| 6,230,988 | B1 | 5/2001 | Chao |
| 6,230,989 | B1 | 5/2001 | Haverstraw |
| 6,237,862 | B1 | 5/2001 | Kah |
| 6,241,158 | B1 | 6/2001 | Clark |
| 6,244,521 | B1 | 6/2001 | Sesser |
| 6,254,013 | B1 | 7/2001 | Clearman |
| 6,264,117 | B1 | 7/2001 | Roman |
| 6,276,460 | B1 | 8/2001 | Pahila |
| 6,286,767 | B1 | 9/2001 | Hui-Chen |
| 6,332,581 | B1 | 12/2001 | Chin |
| 6,336,597 | B1 | 1/2002 | Kah |
| 6,341,733 | B1 | 1/2002 | Sweet |
| 6,345,541 | B1 | 2/2002 | Hendey |
| 6,367,708 | B1 | 4/2002 | Olson |
| D458,342 | S | 6/2002 | Johnson |
| 6,443,372 | B1 | 9/2002 | Hsu |
| 6,454,186 | B2 | 9/2002 | Haverstraw |
| 6,457,656 | B1 | 10/2002 | Scott |
| 6,464,151 | B1 | 10/2002 | Cordua |
| 6,478,237 | B2 | 11/2002 | Kearby |
| 6,481,644 | B1 | 11/2002 | Olsen |
| 6,488,218 | B1 | 12/2002 | Townsend |
| 6,491,235 | B1 | 12/2002 | Scott |
| 6,494,384 | B1 | 12/2002 | Meyer |
| 6,499,672 | B1 | 12/2002 | Sesser |
| 6,516,893 | B2 | 2/2003 | Pahila |
| 6,530,531 | B2 | 3/2003 | Butler |
| 6,601,781 | B2 | 8/2003 | Kah |
| 6,607,147 | B2 | 8/2003 | Schneider |
| 6,622,940 | B2 | 9/2003 | Huang |
| 6,637,672 | B2 | 10/2003 | Cordua |
| 6,651,904 | B2 | 11/2003 | Roman |
| 6,651,905 | B2 | 11/2003 | Sesser |
| 6,688,539 | B2 | 2/2004 | Griend |
| 6,695,223 | B2 | 2/2004 | Beutler |
| 6,715,699 | B1 | 4/2004 | Greenberg |
| 6,719,218 | B2 | 4/2004 | Cool |
| 6,732,950 | B2 | 5/2004 | Ingham, Jr. |
| 6,732,952 | B2 | 5/2004 | Kah |
| 6,736,332 | B2 | 5/2004 | Sesser |
| 6,736,336 | B2 | 5/2004 | Wong |
| 6,737,332 | B1 | 5/2004 | Fuselier |
| 6,769,633 | B1 | 8/2004 | Huang |
| 6,793,152 | B1 | 9/2004 | Drechsel |
| 6,814,304 | B2 | 11/2004 | Onofrio |
| 6,814,305 | B2 | 11/2004 | Townsend |
| 6,817,543 | B2 | 11/2004 | Clark |
| 6,820,825 | B1 | 11/2004 | Wang |
| 6,827,291 | B2 | 12/2004 | Townsend |
| 6,834,816 | B2 | 12/2004 | Kah, Jr. |
| 6,840,460 | B2 | 1/2005 | Clark |
| 6,848,632 | B2 | 2/2005 | Clark |
| 6,854,664 | B2 | 2/2005 | Smith |
| 6,869,026 | B2 | 3/2005 | McKenzie |
| 6,871,795 | B2 | 3/2005 | Anuskiewicz |
| 6,880,768 | B2 | 4/2005 | Lau |
| 6,883,727 | B2 | 4/2005 | Santos |
| 6,899,287 | B2 | 5/2005 | Pinch |
| 6,921,030 | B2 | 7/2005 | Renquist |
| 6,942,164 | B2 | 9/2005 | Walker |
| 6,945,471 | B2 | 9/2005 | McKenzie |
| 6,957,782 | B2 | 10/2005 | Clark |
| 6,976,543 | B1 | 12/2005 | Fischer |
| 6,997,393 | B1 | 2/2006 | Angold |
| 7,017,831 | B2 | 3/2006 | Santiago |
| 7,017,837 | B2 | 3/2006 | Taketomi |
| 7,028,920 | B2 | 4/2006 | Hekman |
| 7,028,927 | B2 | 4/2006 | Mermet |
| 7,032,836 | B2 | 4/2006 | Sesser |
| 7,032,844 | B2 | 4/2006 | Cordua |
| 7,040,553 | B2 | 5/2006 | Clark |
| 7,044,403 | B2 | 5/2006 | Kah |
| 7,070,122 | B2 | 7/2006 | Burcham |
| 7,090,146 | B1 | 8/2006 | Ericksen |
| 7,100,842 | B2 | 9/2006 | Meyer |
| 7,104,472 | B2 | 9/2006 | Renquist |
| 7,111,795 | B2 | 9/2006 | Thong |
| 7,143,957 | B2 | 12/2006 | Nelson |
| 7,143,962 | B2 | 12/2006 | Kah, Jr. |
| 7,152,814 | B1 | 12/2006 | Schapper |
| 7,156,322 | B1 | 1/2007 | Heitzman |
| 7,159,795 | B2 | 1/2007 | Sesser |
| 7,168,634 | B2 | 1/2007 | Onofrio |
| 7,232,078 | B2 | 6/2007 | Kah, Jr. |
| 7,232,081 | B2 | 6/2007 | Kah |
| 7,234,651 | B2 | 6/2007 | Mousavi |
| 7,240,860 | B2 | 7/2007 | Griend |
| 7,287,711 | B2 | 10/2007 | Crooks |
| 7,293,721 | B2 | 11/2007 | Roberts |
| 7,299,999 | B2 | 11/2007 | Walker |

(56) References Cited

U.S. PATENT DOCUMENTS

| | | | |
|---|---|---|---|
| 7,303,147 | B1 | 12/2007 | Danner |
| 7,303,153 | B2 | 12/2007 | Han |
| 7,322,533 | B2 | 1/2008 | Grizzle |
| 7,337,988 | B2 | 3/2008 | McCormick |
| 7,383,721 | B2 | 6/2008 | Parsons |
| 7,389,942 | B2 | 6/2008 | Kenyon |
| RE40,440 | E | 7/2008 | Sesser |
| 7,392,956 | B2 | 7/2008 | McKenzie |
| 7,395,977 | B2 | 7/2008 | Pinch |
| 7,429,005 | B2 | 9/2008 | Schapper |
| 7,458,527 | B2 | 12/2008 | Lutzki |
| 7,478,526 | B2 | 1/2009 | McAfee |
| 7,533,833 | B2 | 5/2009 | Wang |
| 7,581,687 | B2 | 9/2009 | Feith |
| 7,584,906 | B2 | 9/2009 | Lev |
| 7,597,273 | B2 | 10/2009 | McAfee |
| 7,607,588 | B2 | 10/2009 | Nobili |
| 7,611,077 | B2 | 11/2009 | Sesser |
| 7,621,464 | B2 | 11/2009 | Smith |
| 7,621,467 | B1 | 11/2009 | Garcia |
| 7,624,935 | B2 | 12/2009 | Nelson |
| 7,654,474 | B2 | 2/2010 | Cordua |
| 7,686,235 | B2 | 3/2010 | Roberts |
| 7,686,236 | B2 | 3/2010 | Alexander |
| 7,703,706 | B2 | 4/2010 | Walker |
| D615,152 | S | 5/2010 | Kah |
| 7,717,361 | B2 | 5/2010 | Nelson |
| 7,766,259 | B2 | 8/2010 | Feith |
| 7,789,323 | B2 | 9/2010 | Nelson |
| 7,819,339 | B2 | 10/2010 | Dieziger |
| D628,272 | S | 11/2010 | Kah |
| 7,828,229 | B2 | 11/2010 | Kah |
| 7,850,094 | B2 | 12/2010 | Richmond |
| 7,861,948 | B1 | 1/2011 | Crooks |
| D636,459 | S | 4/2011 | Kah |
| 7,926,746 | B2 | 4/2011 | Melton |
| 7,971,804 | B2 | 7/2011 | Roberts |
| RE42,596 | E | 8/2011 | Sesser |
| 8,006,919 | B2 | 8/2011 | Renquist |
| 8,011,602 | B2 | 9/2011 | Coppersmith |
| 8,047,456 | B2 | 11/2011 | Kah |
| 8,056,829 | B2 | 11/2011 | Gregory |
| 8,074,897 | B2 | 12/2011 | Hunnicutt |
| 8,083,158 | B2 | 12/2011 | Katzman |
| 8,205,811 | B2 | 6/2012 | Cordua |
| 8,272,583 | B2 | 9/2012 | Hunnicutt |
| 8,282,022 | B2 | 10/2012 | Porter |
| 8,297,533 | B2 | 10/2012 | Dunn |
| 8,408,482 | B2 | 4/2013 | Gregory |
| 8,567,699 | B2 | 10/2013 | Sesser |
| 8,651,400 | B2 | 2/2014 | Walker |
| 8,672,242 | B2 | 3/2014 | Hunnicutt |
| 8,695,900 | B2 | 4/2014 | Hunnicutt |
| 8,783,582 | B2 | 7/2014 | Robertson |
| 8,789,768 | B2 | 7/2014 | Hunnicutt |
| 8,925,837 | B2 | 1/2015 | Walker |
| 8,991,724 | B2 | 3/2015 | Sesser |
| 8,991,726 | B2 | 3/2015 | Kah, Jr. |
| 8,998,109 | B2 | 4/2015 | Katzman |
| 9,056,214 | B2 | 6/2015 | Barmoav |
| 9,079,202 | B2 | 7/2015 | Walker |
| 9,174,227 | B2 | 11/2015 | Robertson |
| 9,179,612 | B2 | 11/2015 | Nelson |
| 9,248,459 | B2 | 2/2016 | Kah, Jr. |
| 9,295,998 | B2 | 3/2016 | Shadbolt |
| 9,314,952 | B2 | 4/2016 | Walker |
| 9,327,297 | B2 | 5/2016 | Walker |
| 9,387,496 | B2 | 7/2016 | Kah, III |
| 9,427,751 | B2 | 8/2016 | Kim |
| 9,492,832 | B2 | 11/2016 | Kim |
| 9,504,209 | B2 | 11/2016 | Kim |
| 9,534,619 | B2 | 1/2017 | Sesser |
| 9,555,422 | B2 | 1/2017 | Zhao |
| 9,587,687 | B2 | 3/2017 | Sesser |
| 9,669,420 | B2 | 6/2017 | Heren |
| 9,757,743 | B2 | 9/2017 | Kah, Jr. |
| 9,808,813 | B1 | 11/2017 | Porter |
| 9,981,276 | B2 | 5/2018 | Kah, Jr. |
| 10,201,818 | B2 | 2/2019 | Duffin |
| 10,213,802 | B2 | 2/2019 | Kah, Jr. |
| 10,232,388 | B2 | 3/2019 | Glezerman |
| 10,232,389 | B1 | 3/2019 | Forrest |
| 10,239,067 | B2 | 3/2019 | Glezerman |
| 10,322,422 | B2 | 6/2019 | Simmons |
| 10,322,423 | B2 | 6/2019 | Walker |
| 2001/0023901 | A1 | 9/2001 | Haverstraw |
| 2002/0070289 | A1 | 6/2002 | Hsu |
| 2002/0130202 | A1 | 9/2002 | Kah |
| 2002/0139868 | A1 | 10/2002 | Sesser |
| 2002/0153434 | A1 | 10/2002 | Cordua |
| 2003/0006304 | A1 | 1/2003 | Cool |
| 2003/0015606 | A1 | 1/2003 | Cordua |
| 2003/0042327 | A1 | 3/2003 | Beutler |
| 2003/0071140 | A1 | 4/2003 | Roman |
| 2003/0075620 | A1 | 4/2003 | Kah, Jr. |
| 2004/0108391 | A1 | 6/2004 | Onofrio |
| 2005/0006501 | A1 | 1/2005 | Englefield |
| 2005/0161534 | A1 | 7/2005 | Kah |
| 2005/0194464 | A1 | 9/2005 | Bruninga |
| 2005/0194479 | A1 | 9/2005 | Curtis |
| 2005/0199842 | A1 | 9/2005 | Parsons |
| 2006/0038046 | A1 | 2/2006 | Curtis |
| 2006/0086832 | A1 | 4/2006 | Roberts |
| 2006/0086833 | A1 | 4/2006 | Roberts |
| 2006/0108445 | A1 | 5/2006 | Pinch |
| 2006/0144968 | A1 | 7/2006 | Lev |
| 2006/0219815 | A1 | 10/2006 | Hekman |
| 2006/0237198 | A1 | 10/2006 | Crampton |
| 2006/0273202 | A1 | 12/2006 | Su |
| 2006/0281375 | A1 | 12/2006 | Jordan |
| 2007/0012800 | A1 | 1/2007 | McAfee |
| 2007/0034711 | A1 | 2/2007 | Kah |
| 2007/0034712 | A1 | 2/2007 | Kah |
| 2007/0119975 | A1 | 5/2007 | Hunnicutt |
| 2007/0181711 | A1 | 8/2007 | Sesser |
| 2007/0235565 | A1 | 10/2007 | Kah |
| 2007/0246567 | A1 | 10/2007 | Roberts |
| 2008/0087743 | A1 | 4/2008 | Govrin |
| 2008/0169363 | A1 | 7/2008 | Walker |
| 2008/0217427 | A1 | 9/2008 | Wang |
| 2008/0257982 | A1 | 10/2008 | Kah |
| 2008/0276391 | A1 | 11/2008 | Jung |
| 2008/0277499 | A1 | 11/2008 | McAfee |
| 2009/0001193 | A1 | 1/2009 | Parsons |
| 2009/0008484 | A1 | 1/2009 | Feith |
| 2009/0014559 | A1 | 1/2009 | Marino |
| 2009/0072048 | A1 | 3/2009 | Renquist |
| 2009/0078788 | A1 | 3/2009 | Holmes |
| 2009/0108099 | A1 | 4/2009 | Porter |
| 2009/0140076 | A1 | 6/2009 | Cordua |
| 2009/0173803 | A1 | 7/2009 | Kah |
| 2009/0173904 | A1 | 7/2009 | Roberts |
| 2009/0179165 | A1 | 7/2009 | Parsons |
| 2009/0188988 | A1 | 7/2009 | Walker |
| 2009/0224070 | A1 | 9/2009 | Clark |
| 2010/0090024 | A1 | 4/2010 | Hunnicutt |
| 2010/0108787 | A1 | 5/2010 | Walker |
| 2010/0176217 | A1 | 7/2010 | Richmond |
| 2010/0257670 | A1 | 10/2010 | Hodel |
| 2010/0276512 | A1 | 11/2010 | Nies |
| 2010/0301135 | A1 | 12/2010 | Hunnicutt |
| 2010/0301142 | A1 | 12/2010 | Hunnicutt |
| 2011/0024522 | A1 | 2/2011 | Anuskiewicz |
| 2011/0089250 | A1 | 4/2011 | Zhao |
| 2011/0121097 | A1 | 5/2011 | Walker |
| 2011/0147484 | A1 | 6/2011 | Jahan |
| 2011/0248093 | A1 | 10/2011 | Kim |
| 2011/0248094 | A1 | 10/2011 | Robertson |
| 2011/0248097 | A1 | 10/2011 | Kim |
| 2011/0309161 | A1 | 12/2011 | Renquist |
| 2011/0309274 | A1 | 12/2011 | Parsons |
| 2012/0012670 | A1 | 1/2012 | Kah |
| 2012/0061489 | A1 | 3/2012 | Hunnicutt |
| 2012/0153051 | A1 | 6/2012 | Kah |

(56) References Cited

U.S. PATENT DOCUMENTS

| | | | |
|---|---|---|---|
| 2012/0292403 | A1 | 11/2012 | Hunnicutt |
| 2013/0334332 | A1 | 12/2013 | Robertson |
| 2013/0334340 | A1 | 12/2013 | Walker |
| 2014/0027526 | A1 | 1/2014 | Shadbolt |
| 2014/0027527 | A1 | 1/2014 | Walker |
| 2014/0224900 | A1 | 8/2014 | Kim |
| 2014/0339334 | A1 | 11/2014 | Kah |
| 2015/0224520 | A1 | 8/2015 | Kim |
| 2016/0107177 | A1 | 4/2016 | Kah, Jr. |
| 2016/0151795 | A1 | 6/2016 | Yitzhak |
| 2017/0056899 | A1 | 3/2017 | Kim |
| 2017/0203311 | A1 | 7/2017 | Kim |
| 2017/0348709 | A1 | 12/2017 | Kah, Jr. |
| 2018/0141060 | A1 | 5/2018 | Walker |
| 2018/0221895 | A1 | 8/2018 | McCarty |
| 2018/0250692 | A1 | 9/2018 | Kah, Jr. |
| 2018/0280994 | A1 | 10/2018 | Walker |
| 2018/0311684 | A1 | 11/2018 | Lawyer |
| 2019/0015849 | A1 | 1/2019 | Geerligs |
| 2019/0054480 | A1 | 2/2019 | Sesser |
| 2019/0054481 | A1 | 2/2019 | Sesser |
| 2019/0118195 | A1 | 4/2019 | Geerligs |
| 2019/0133059 | A1 | 5/2019 | DeWitt |
| 2019/0143361 | A1 | 5/2019 | Kah, Jr. |
| 2019/0193095 | A1 | 6/2019 | Sesser |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| DE | 19925279 | | 12/1999 |
| EP | 0274082 | | 7/1988 |
| EP | 0463742 | | 1/1992 |
| EP | 0489679 | | 6/1992 |
| EP | 0518579 | | 12/1992 |
| EP | 0572747 | | 12/1993 |
| EP | 0646417 | | 4/1995 |
| EP | 0724913 | A2 | 8/1996 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| EP | 3311926 | | 4/2018 |
| FR | 2730901 | | 9/1997 |
| GB | 908314 | | 10/1962 |
| GB | 1234723 | | 6/1971 |
| GB | 2330783 | | 5/1999 |
| IL | 35182 | | 4/1973 |
| WO | 1995020988 | | 8/1995 |
| WO | 1997027951 | | 8/1997 |
| WO | 9735668 | | 10/1997 |
| WO | 2000007428 | | 12/2000 |
| WO | 200131996 | | 5/2001 |
| WO | 2001031996 | | 5/2001 |
| WO | 200162395 | | 8/2001 |
| WO | 2001062395 | | 8/2001 |
| WO | 2002078857 | | 10/2002 |
| WO | 2002098570 | | 12/2002 |
| WO | 2003086643 | | 10/2003 |
| WO | 2004052721 | | 6/2004 |
| WO | 2005099905 | | 10/2005 |
| WO | 2005115554 | | 12/2005 |
| WO | 2005123263 | | 12/2005 |
| WO | 2006108298 | | 10/2006 |
| WO | 2007131270 | | 11/2007 |
| WO | 2008130393 | | 10/2008 |
| WO | 2009036382 | | 3/2009 |
| WO | 2010036241 | | 4/2010 |
| WO | 2010126769 | | 11/2010 |
| WO | 2011075690 | | 6/2011 |
| WO | 2014018892 | | 1/2014 |
| WO | 2014124314 | | 8/2014 |

OTHER PUBLICATIONS

Applicant-Initiated Interview Summary and Final Office Action dated Mar. 5, 2014 for U.S. Appl. No. 12/972,271 (12 pgs.).

European Patent Office, Extended European Search Report and Opinion for European Patent Application No. 17197674.9 dated Mar. 26, 2018, 8 pages.

European Patent Office, Extended European Search Report for European Patent Application No. 17201824.4 dated Jul. 30, 2018 (14 pages).

European Patent Office, Partial European Search Report and Opinion for European Patent Application No. 17201824.4 dated Apr. 20, 2018 (16 pages).

European Patent Office, Search Report and Opinion for European Application No. 10164085.2 dated Aug. 5, 2010 (5 pages).

Final Office Action dated Apr. 5, 2011 for U.S. Appl. No. 11/947,571 (11 pgs.).

Final Office Action dated Dec. 5, 2013 for U.S. Appl. No. 12/972,271 (9 pgs.).

Interview Summary dated Sep. 26, 2011 for U.S. Appl. No. 12/475,242 (3 pgs.).

Non-Final Office Action dated Dec. 16, 2014 for U.S. Appl. No. 13/560,423 (18 pgs.).

Non-Final Office Action dated Jan. 10, 2014 for U.S. Appl. No. 13/069,334 (6 pgs.).

Non-Final Office Action dated Jan. 22, 2015 for U.S. Appl. No. 13/828,582 (21 pgs.).

Non-Final Office Action dated Nov. 5, 2014 for U.S. Appl. No. 13/495,402.

Non-Final Office Action dated Apr. 10, 2013 for U.S. Appl. No. 13/562,825 (22 pgs.).

Non-Final Office Action dated Aug. 24, 2010 for U.S. Appl. No. 11/947,571 (11 pgs.).

Non-Final Office Action dated Dec. 16, 2014 for U.S. Appl. No. 13/560,423.

Non-Final Office Action dated Dec. 4, 2012 for U.S. Appl. No. 12/686,895 (29 pgs.).

Non-Final Office Action dated Jan. 5, 2011 for U.S. Appl. No. 12/248,644 (20 pgs.).

Non-Final Office Action dated Jul. 20, 2011 for U.S. Appl. No. 12/475,242 (17 pgs.).

Non-Final Office Action dated Jun. 5, 2013 for U.S. Appl. No. 12/972,271 (8 pgs.).

Non-Final Office Action dated Jun. 7, 2012 for U.S. Appl. No. 13/300,946 (9 pgs.).

Non-Final Office Action dated Mar. 29, 2011 for U.S. Appl. No. 12/475,242 (7 pgs.).

Non-Final Office Action dated May 24, 2013 U.S. Appl. No. 12/720,261 (67 pgs.).

Non-Final Office Action dated Oct. 12, 2012 for U.S. Appl. No. 13/300,946 (7 pgs.).

Non-Final Office Action dated Oct. 15, 2012 for U.S. Appl. No. 13/562,825 (10 pgs.).

Non-Final Office Action dated Oct. 15, 2012 for U.S. Appl. No. 13/562,825 (20 pgs.).

Non-Final Office Action dated Sep. 3, 2013 for U.S. Appl. No. 13/300,946. (5 pgs.).

Non-Final Office Action dated Sep. 30, 2010 for U.S. Appl. No. 12/248,644 (7 pgs.).

(56) References Cited

OTHER PUBLICATIONS

Patent Cooperation Treaty, Written Opinion of the International Searching Authority and International Search Report for International Application No. PCT/US2010/061132 dated Apr. 19, 2011 (12 pages).
Response dated Apr. 10, 2015 to Office Action dated Dec. 16, 2014 for U.S. Appl. No. 13/560,423 (21 pgs).
Response dated Apr. 22, 2015 to Non-Final Office Action dated Jan. 22, 2015 for U.S. Appl. No. 13/828,582 (19 pgs).
Response dated Apr. 29, 2011 to Office Action dated Mar. 29, 2011 for U.S. Appl. No. 12/475,242 (13 pgs.).
Response dated Feb. 10, 2014 to Office Action dated Jan. 10, 2014 for U.S. Appl. No. 13/069,334 (3 pgs.).
Response dated Feb. 4, 2015 to Office Action dated Nov. 5, 2014 for U.S. Appl. No. 13/495,402 (16 pgs.).
Response dated Jul. 25, 2012 to Non-Final Office Action dated Apr. 25, 2012 for U.S. Appl. No. 12/757,912 (27 pgs.).
Response dated Jun. 25, 2012 to Office Action dated Jun. 7, 2012 for U.S. Appl. No. 13/300,946 (12 pgs.).
Response dated Mar. 25, 2013 to Final Rejection dated Oct. 23, 2012 for U.S. Appl. No. 12/757,912 (20 pgs.).
Response dated Nov. 24, 2010 to Office Action dated Aug. 24, 2010 for U.S. Appl. No. 11/947,571 (19 pgs.).
Response dated Oct. 18, 2011 to Office Action dated Jul. 20, 2011 for U.S. Appl. No. 11/947,571 (11 pgs.).
Response dated Oct. 18, 2011 to Office Action dated Jul. 20, 2011 for U.S. Appl. No. 12/475,242 (17 pgs.).
Response dated Sep. 16, 2013 to Office Action dated Jun. 5, 2013 for U.S. Appl. No. 12/972,271 (15 pgs.).
USPTO Applicant-Initiated Interview Summary dated Apr. 23, 2013 for U.S. Appl. No. 12/757,912 (3 pgs.).
USPTO Final Rejection dated Oct. 23, 2012 for U.S. Appl. No. 12/757,912 (19 pgs.).
USPTO Non-Final Office Action dated Apr. 25, 2012 for U.S. Appl. No. 12/757,912 (17 pgs.).
U.S. Appl. No. 13/828,582; Non-Final Office Action dated Jan. 22, 2015.
U.S. Appl. No. 13/495,402; Notice of Allowance dated Mar. 6, 2015.
U.S. Appl. No. 15/359,286; Notice of Allowance dated Mar. 1, 2019; (pp. 1-5).
U.S. Appl. No. 15/359,286; Notice of Allowance dated Jun. 5, 2018; (pp. 1-9).
U.S. Appl. No. 15/359,286; Office Action dated Jan. 16, 2019; (pp. 1-8).
U.S. Appl. No. 15/359,286; Office Action dated Sep. 24, 2018; (pp. 1-9).
U.S. Appl. No. 16/409,510; Office Action dated Feb. 4, 2021; (pp. 1-10).

ROTARY NOZZLE

CROSS-REFERENCE TO RELATED APPLICATION

This application is a continuation application of U.S. application Ser. No. 15/359,286, filed Nov. 22, 2016, which is incorporated by reference in its entirety herein.

FIELD

This invention relates to irrigation sprinklers and, more particularly, to an irrigation nozzle with a rotating deflector.

BACKGROUND

Nozzles are commonly used for the irrigation of landscape and vegetation. In a typical irrigation system, various types of nozzles are used to distribute water over a desired area, including rotating stream type and fixed spray pattern type nozzles. One type of irrigation nozzle is the rotating deflector or so-called micro-stream type having a rotatable vaned deflector for producing a plurality of relatively small water streams swept over a surrounding terrain area to irrigate adjacent vegetation.

Rotating stream nozzles of the type having a rotatable vaned deflector for producing a plurality of relatively small outwardly projected water streams are known in the art. In such nozzles, one or more jets of water are generally directed upwardly against a rotatable deflector having a vaned lower surface defining an array of relatively small flow channels extending upwardly and turning radially outwardly with a spiral component of direction. The water jet or jets impinge upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range of throw depending on the radius reduction of water through the nozzle, among other things.

In rotating stream nozzles and in other nozzles, it is desirable to control the arcuate area through which the nozzle distributes water. In this regard, it is desirable to use a nozzle that distributes water through a variable pattern, such as a full circle, half-circle, or some other arc portion of a circle, at the discretion of the user. Traditional variable arc nozzles suffer from limitations with respect to setting the water distribution arc. Some have used interchangeable pattern inserts to select from a limited number of water distribution arcs, such as quarter-circle or half-circle. Others have used punch-outs to select a fixed water distribution arc, but once a distribution arc was set by removing some of the punch-outs, the arc could not later be reduced. Many conventional nozzles have a fixed, dedicated construction that permits only a discrete number of arc patterns and prevents them from being adjusted to any arc pattern desired by the user.

Other conventional nozzle types allow a variable arc of coverage but only for a very limited arcuate range. Because of the limited adjustability of the water distribution arc, use of such conventional nozzles may result in overwatering or underwatering of surrounding terrain. This is especially true where multiple nozzles are used in a predetermined pattern to provide irrigation coverage over extended terrain. In such instances, given the limited flexibility in the types of water distribution arcs available, the use of multiple conventional nozzles often results in an overlap in the water distribution arcs or in insufficient coverage. Thus, certain portions of the terrain are overwatered, while other portions are not watered at all. Accordingly, there is a need for a variable arc nozzle that allows a user to set the water distribution arc along a substantial continuum of arcuate coverage, rather than several models that provide a limited arcuate range of coverage.

DESCRIPTION OF THE PREFERRED EMBODIMENT

Figure 1:
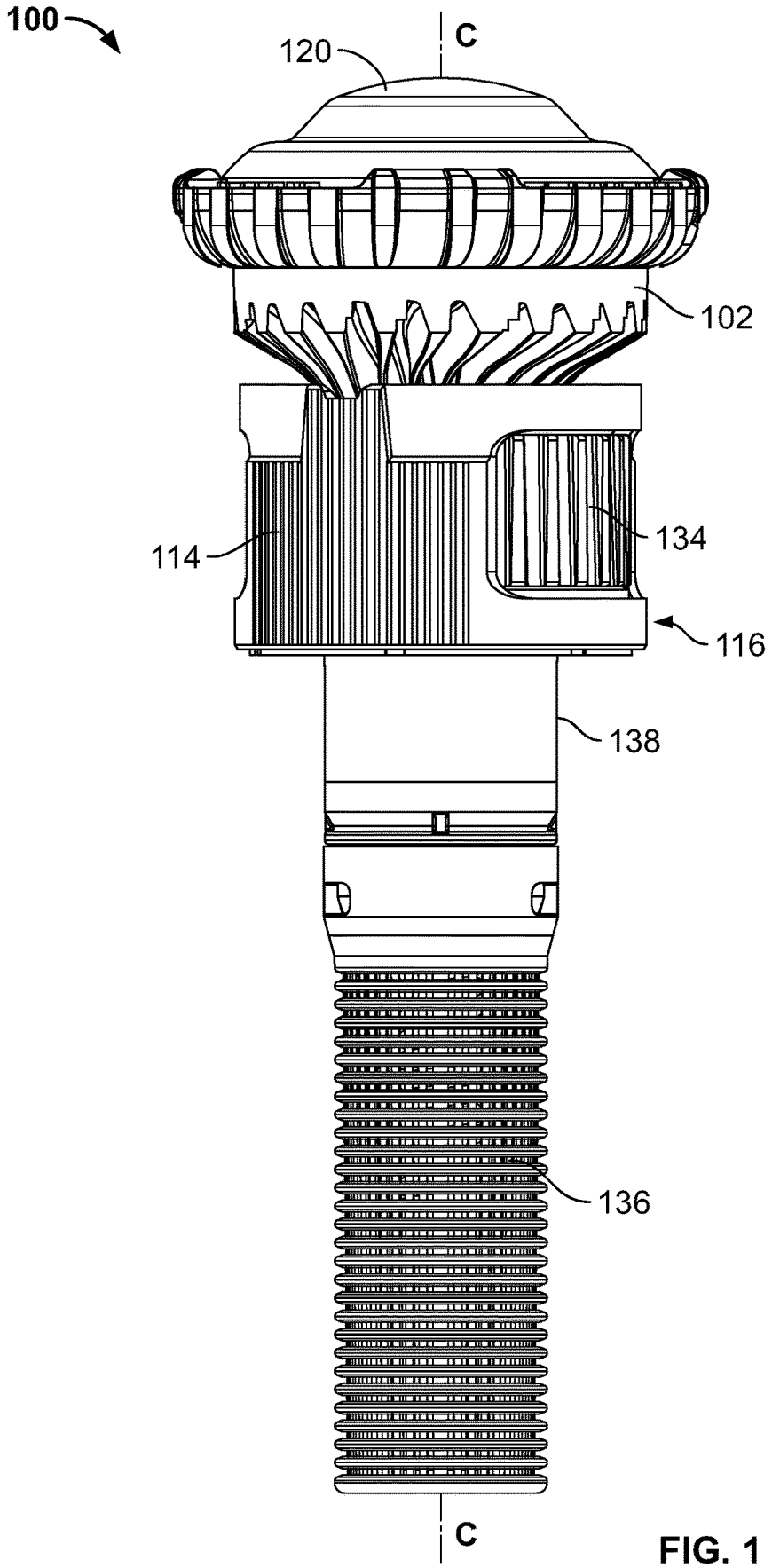
FIG. 1 is an elevation view of a preferred embodiment of a nozzle embodying features of the present invention.
Figure 2:
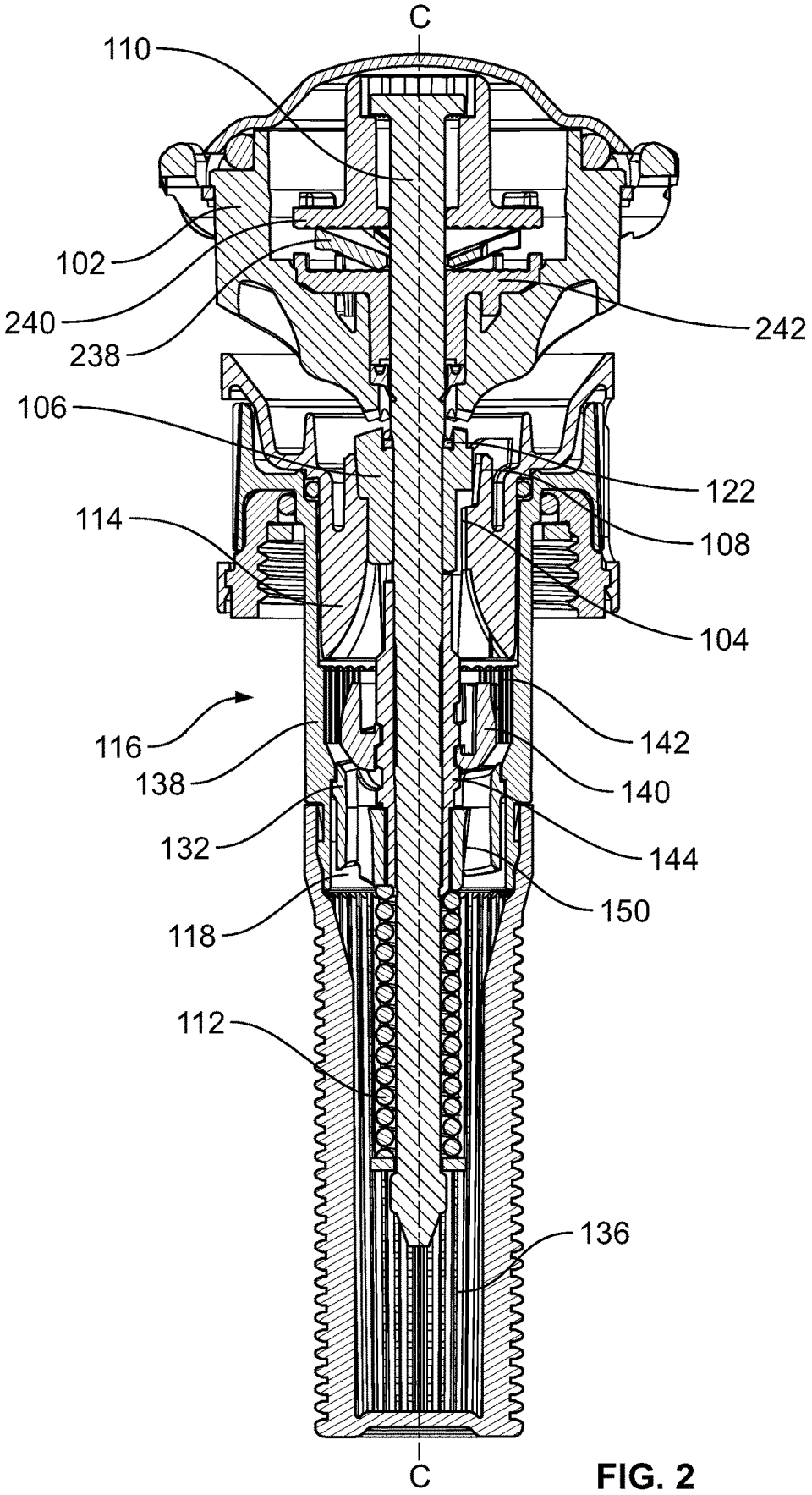
FIG. 2 is a cross-sectional view of the nozzle of FIG. 1.

FIGS. 1 and 2 show a preferred embodiment of the nozzle 100. The nozzle 100 possesses an arc adjustability capability that allows a user to generally set the arc of water distribution to virtually any desired angle. The arc adjustment feature does not require a hand tool to access a slot at the top of the nozzle 100 to rotate a shaft. Instead, the user may depress part or all of the deflector 102 and rotate the deflector 102 to directly set an arc adjustment valve 104. The nozzle 100 also preferably includes a flow rate adjustment feature (or radius reduction feature), which is shown in FIG. 2, to regulate flow rate and throw radius. The radius reduction feature is accessible by rotating an outer wall portion of the nozzle 100, as described further below.

The arc adjustment and radius reduction features of the nozzle 100 are similar to those described in U.S. Pat. Nos. 8,925,837 and 9,079,202, which are assigned to the assignee of the present application and which patents are incorporated herein by reference in their entirety. Further, some of the structural components of the nozzle 100 are preferably similar to those described in U.S. Pat. Nos. 8,925,837 and 9,079,202, and, as stated, the patents are incorporated herein by reference in their entirety. Differences in the arc adjustment feature, radius reduction feature, and structural components are addressed below and with reference to the figures.

As described in more detail below, the nozzle 100 allows a user to depress and rotate a deflector 102 to directly actuate the arc adjustment valve 104, i.e., to open and close the valve. The user depresses the deflector 102 to directly engage and rotate one of the two nozzle body portions that forms the valve 104 (valve sleeve 106). The valve 104 preferably operates through the use of two helical engagement surfaces that cam against one another to define an arcuate opening 108. Although the nozzle 100 preferably includes a shaft 110, the user does not need to use a hand tool to effect rotation of the shaft 110 to open and close the arc adjustment valve 104. The shaft 110 is not rotated to cause opening and closing of the valve 104. Indeed, the shaft 110 is preferably fixed against rotation, such as through use of splined engagement surfaces.

The nozzle 100 also preferably uses a spring 112 mounted to the shaft 110 to energize and tighten the seal of the closed portion of the arc adjustment valve 104. More specifically, the spring 112 operates on the shaft 110 to bias the first of the two nozzle body portions that forms the valve 104 (valve sleeve 106) downwardly against the second portion (nozzle cover 114). In one preferred form, the shaft 110 translates up and down a total distance corresponding to one helical pitch. The vertical position of the shaft 110 depends on the orientation of the two helical engagement surfaces with respect to one another. By using a spring 112 to maintain a forced engagement between valve sleeve 106 and nozzle cover 114, the nozzle 100 provides a tight seal of the closed portion of the arc adjustment valve 104, concentricity of the valve 104, and a uniform jet of water directed through the valve 104. In addition, mounting the spring 112 at one end of the shaft 110 results in a lower cost of assembly.

Figure 7:
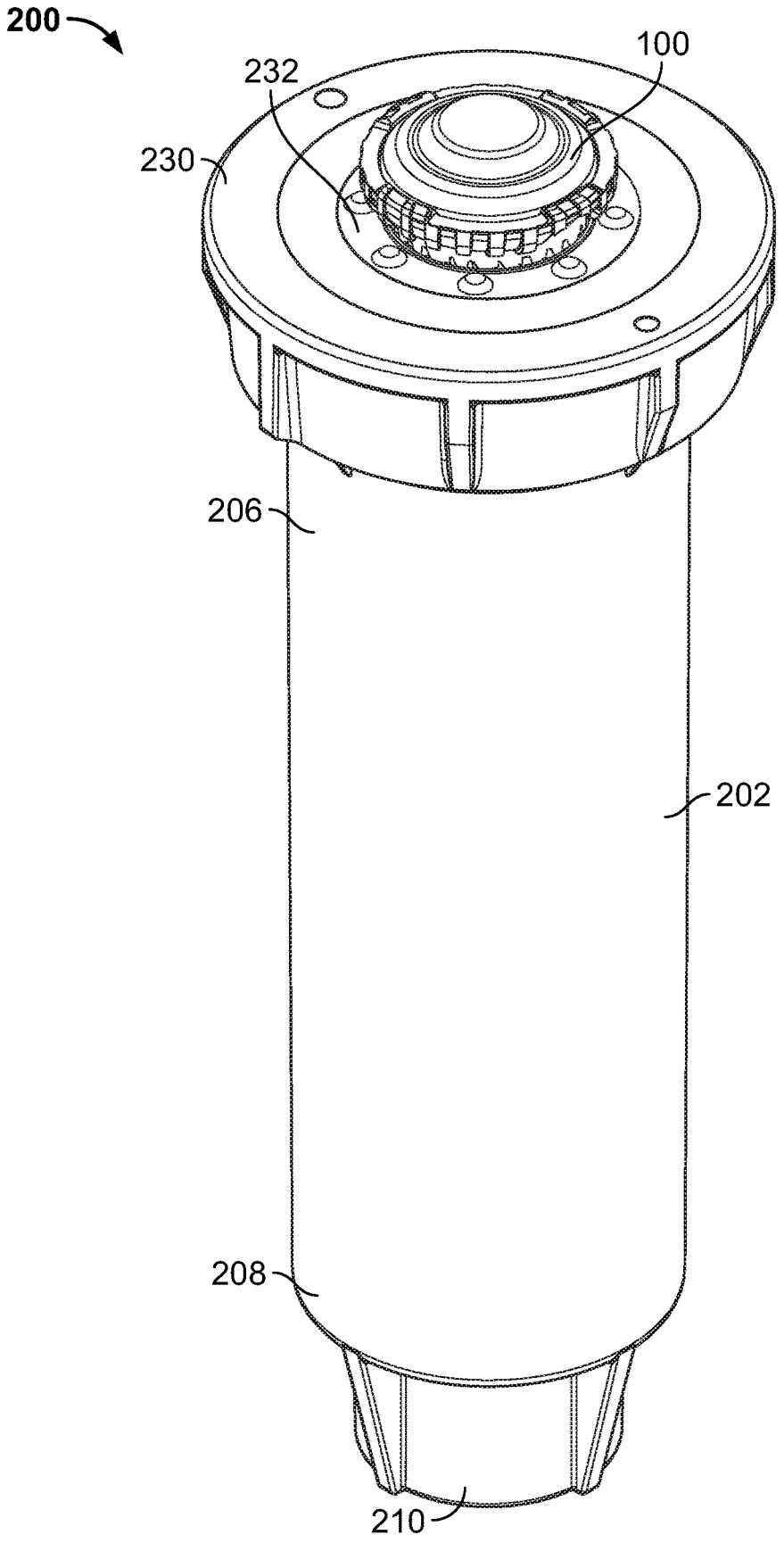
FIG. 7 is a perspective view of a sprinkler assembly including the nozzle of FIG. 1.
Figure 8:
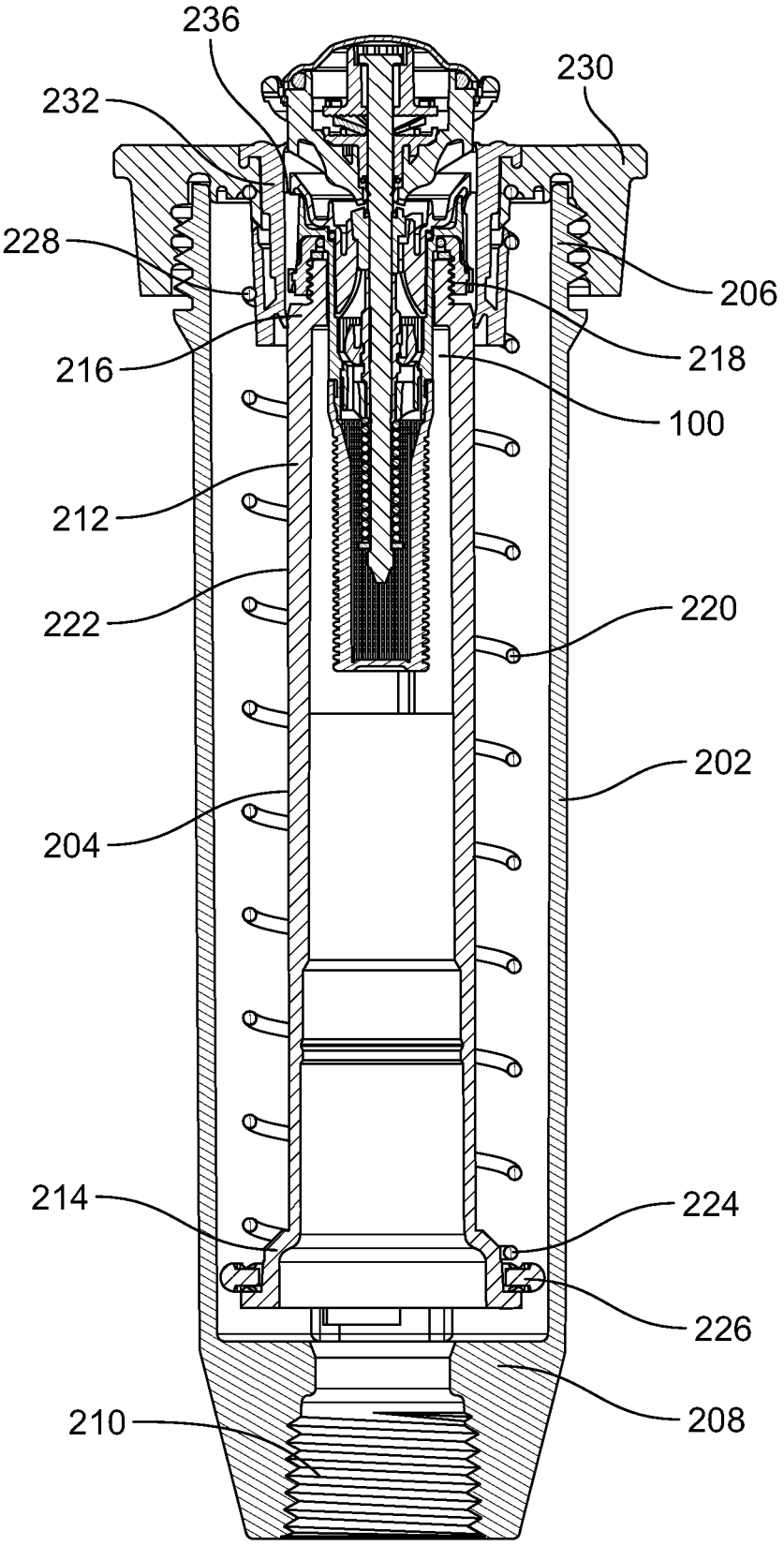
FIG. 8 is a cross-sectional view of the sprinkler assembly of FIG. 7.

As can be seen in FIGS. 1 and 2, the nozzle 100 generally comprises a compact unit, preferably made primarily of lightweight molded plastic, which is adapted for convenient thread-on mounting onto the upper end of a stationary or pop-up riser (FIGS. 7 and 8). In operation, water under pressure is delivered through the riser to a nozzle body 116. The water preferably passes through an inlet 118 controlled by an adjustable flow rate feature that regulates the amount of fluid flow through the nozzle body 116. The water is then directed through an arcuate opening 108 that determines the arcuate span of water distributed from the nozzle 100. Water is directed generally upwardly through the arcuate opening 108 to produce one or more upwardly directed water jets that impinge the underside surface of a deflector 102 for rotatably driving the deflector 102.

Figure 4:
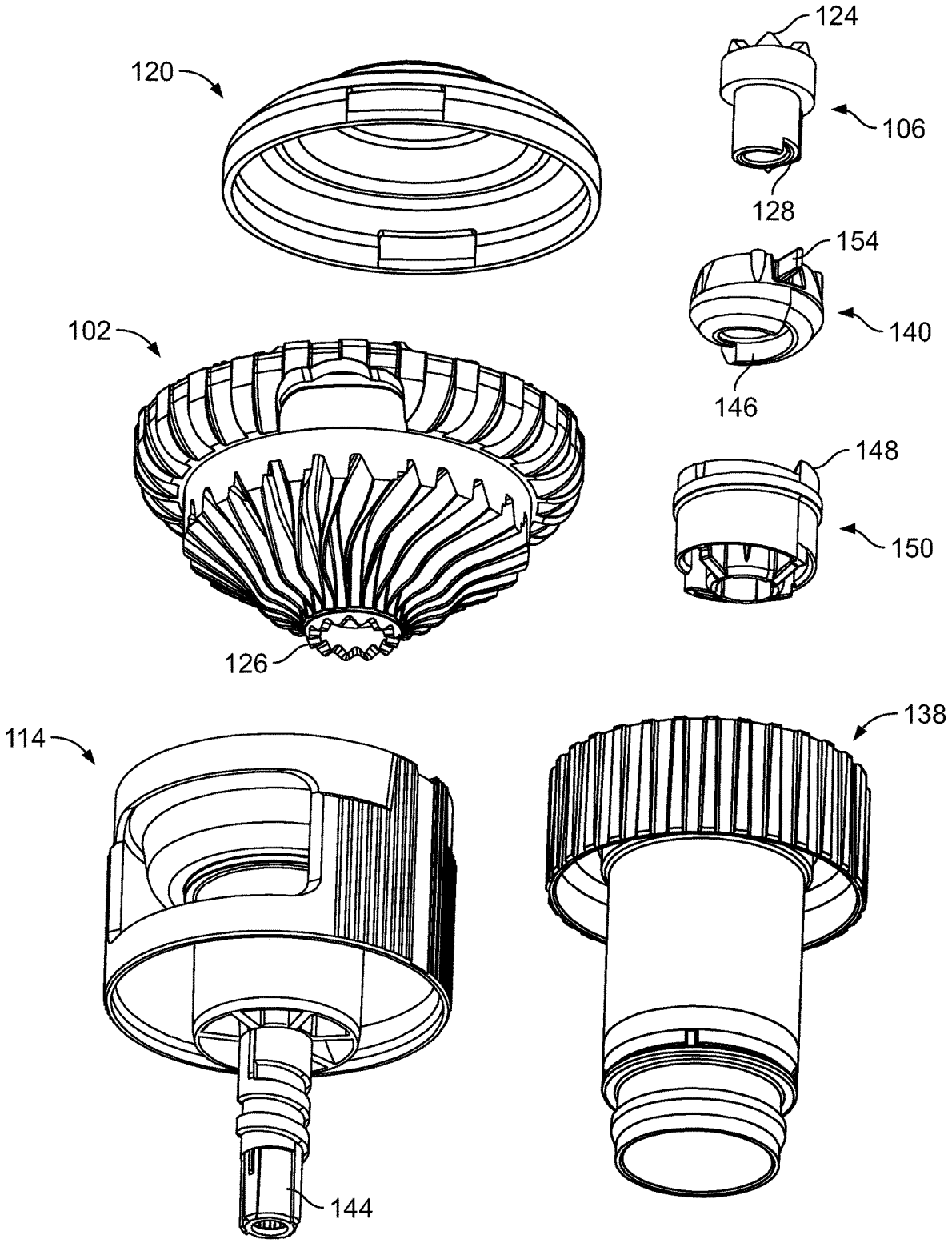
FIG. 4 is a bottom perspective view of the cap, deflector, nozzle cover, valve sleeve, throttle nut, valve seat, and nozzle collar of the nozzle of FIG. 1.

The rotatable deflector 102 has an underside surface that is contoured to deliver a plurality of fluid streams generally radially outwardly therefrom through an arcuate span. As shown in FIG. 4, the underside surface of the deflector 102 preferably includes an array of spiral vanes. The spiral vanes subdivide the water jet or jets into the plurality of relatively small water streams which are distributed radially outwardly therefrom to surrounding terrain as the deflector 102 rotates. The vanes define a plurality of intervening flow channels extending upwardly and spiraling along the underside surface to extend generally radially outwardly with selected inclination angles. A cap 120 is mounted on the deflector 102 to limit the ingress of debris and particulate material into the sensitive components in the interior of the deflector 102, which might otherwise interfere with operation of the nozzle 100. During operation of the nozzle 100, the upwardly directed water jet or jets impinge upon the lower or upstream segments of these vanes, which subdivide the water flow into the plurality of relatively small flow streams for passage through the flow channels and radially outward projection from the nozzle 100. The vanes are curved in a manner and direction to drive rotation of the deflector 102. A deflector like the type shown in U.S. Pat. No. 6,814,304, which is assigned to the assignee of the present application and is incorporated herein by reference in its entirety, is preferably used. Other types of deflectors, however, may also be used.

Figure 3:
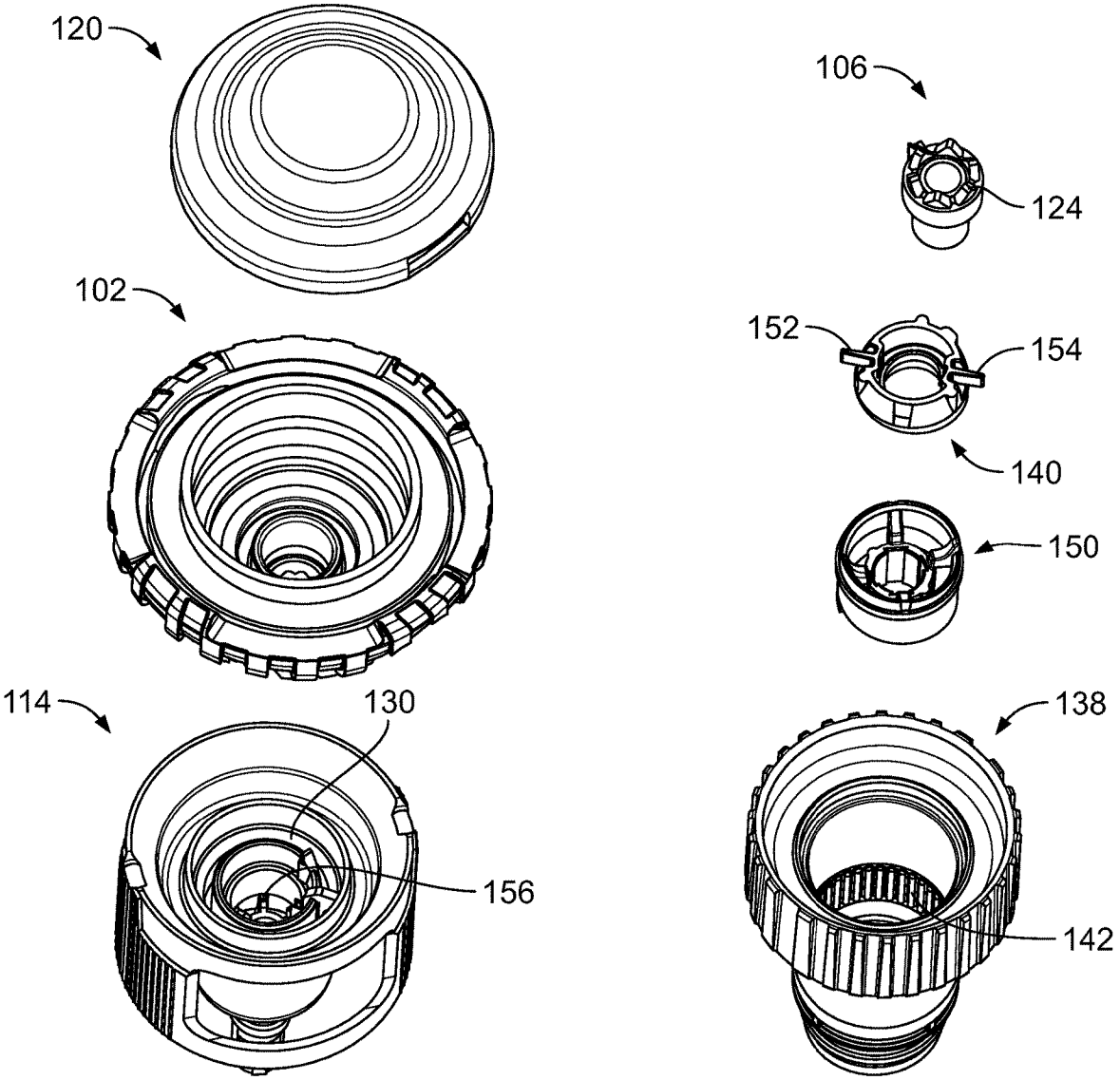
FIG. 3 is a top perspective view of the cap, deflector, nozzle cover, valve sleeve, throttle nut, valve seat, and nozzle collar of the nozzle of FIG. 1.

The variable arc capability of nozzle 100 results from the interaction of two portions of the nozzle body 116 (nozzle cover 114 and valve sleeve 106). More specifically, as can be seen in FIGS. 3 and 4, the nozzle cover 114 and the valve sleeve 106 have corresponding helical engagement surfaces. The valve sleeve 106 may be rotatably adjusted with respect to the nozzle cover 114 to close the arc adjustment valve 104, i.e., to adjust the length of arcuate opening 108, and this rotatable adjustment also results in upward or downward translation of the valve sleeve 106. In turn, this camming action results in upward or downward translation of the shaft 110 with the valve sleeve 106. The arcuate opening 108 may be adjusted to a desired water distribution arc by the user through push down and rotation of the deflector 102.

As shown in FIGS. 2-4, the valve sleeve 106 has a generally cylindrical shape. The valve sleeve 106 includes a central hub defining a bore therethrough for insertion of the shaft 110. The downward biasing force of spring 112 against shaft 110 results in a friction press fit between an inclined shoulder of the shaft 110, a retaining washer 122, and a top surface of the valve sleeve 106. The valve sleeve 106 preferably has a top surface defining teeth 124 formed therein for engagement with the deflector teeth 126. The valve sleeve 106 also includes a bottom helical surface 128 that engages and cams against a corresponding helical surface 130 of the nozzle cover 114 to form the arc adjustment valve 104. As shown in FIG. 3, the non-rotating nozzle cover 114 has an internal helical surface 130 that defines approximately one 360 degree helical revolution, or pitch.

The arcuate span of the nozzle 100 is determined by the relative positions of the internal helical surface 130 of the nozzle cover 114 and the complementary external helical surface 128 of the valve sleeve 106, which act together to form the arcuate opening 108. The camming interaction of the valve sleeve 106 with the nozzle cover 114 forms the arcuate opening 108, as shown in FIG. 2, where the arc is open on the right side of the C-C axis. The length of the arcuate opening 108 is determined by push down and rotation of the deflector 102 (which in turn rotates the valve sleeve 106) relative to the non-rotating nozzle cover 114. The valve sleeve 106 may be rotated with respect to the nozzle cover 114 along the complementary helical surfaces through approximately a ¾ helical pitch to raise or lower the valve sleeve 106. The valve sleeve 106 may be rotated through approximately one 270 degree helical pitch with respect to the nozzle cover 114. The valve sleeve 106 may be rotated relative to the nozzle cover 114 to an arc desired by the user and is not limited to discrete arcs, such as quarter-circle and half-circle.

In an initial lowermost position, the valve sleeve 106 is at the lowest point of the helical turn on the nozzle cover 114 and completely obstructs the flow path through the arcuate opening 108. As the valve sleeve 106 is rotated in the clockwise direction, however, the complementary external helical surface 128 of the valve sleeve 106 begins to traverse the helical turn on the internal surface 130 of the nozzle cover 114. As it begins to traverse the helical turn, a portion of the valve sleeve 106 is spaced from the nozzle cover 114 and a gap, or arcuate opening 108, begins to form between the valve sleeve 106 and the nozzle cover 114. This gap, or arcuate opening 108, provides part of the flow path for water flowing through the nozzle 100. The angle of the arcuate opening 108 increases as the valve sleeve 106 is further rotated clockwise and the valve sleeve 106 continues to traverse the helical turn.

When the valve sleeve 106 is rotated counterclockwise, the angle of the arcuate opening 108 is decreased. The complementary external helical surface 128 of the valve sleeve 106 traverses the helical turn in the opposite direction until it reaches the bottom of the helical turn. When the surface 128 of the valve sleeve 106 has traversed the helical turn completely, the arcuate opening 108 is closed and the flow path through the nozzle 100 is completely or almost completely obstructed. It should be evident that the direction of rotation of the valve sleeve 106 for either opening or closing the arcuate opening 108 can be easily reversed, i.e., from clockwise to counterclockwise or vice versa, such as by changing the thread orientation.

As shown in FIG. 2, the nozzle 100 also preferably includes a radius reduction valve 132. The radius reduction valve 132 can be used to selectively set the water flow rate through the nozzle 100, for purposes of regulating the range of throw of the projected water streams. It is adapted for variable setting through use of a rotatable segment 134 located on an outer wall portion of the nozzle 100. It functions as a second valve that can be opened or closed to allow the flow of water through the nozzle 100. Also, a filter 136 is preferably located upstream of the radius reduction valve 132, so that it obstructs passage of sizable particulate and other debris that could otherwise damage the sprinkler components or compromise desired efficacy of the nozzle 100.

As shown in FIG. 2, the radius reduction valve structure preferably includes a nozzle collar 138, a flow control member (preferably in the form of throttle nut 140), and the nozzle cover 114. The nozzle collar 138 is rotatable about the central axis C-C of the nozzle 100. It has an internal engagement surface 142 that engages the throttle nut 140 so that rotation of the nozzle collar 138 results in rotation of the throttle nut 140. The throttle nut 140 also threadedly engages a post 144 of the nozzle cover 114 such that rotation of the throttle nut 140 causes it to move in an axial direction, as described further below. In this manner, rotation of the nozzle collar 138 can be used to move the throttle nut 140 axially closer to and further away from an inlet 118. When the throttle nut 140 is moved closer to the inlet 118, the flow rate is reduced. The axial movement of the throttle nut 140 towards the inlet 118 increasingly pinches the flow through the inlet 118. When the throttle nut 140 is moved further away from the inlet 118, the flow rate is increased. This axial movement allows the user to adjust the effective throw radius of the nozzle 100 without disruption of the streams dispersed by the deflector 102.

As can be seen in FIGS. 2-4, the throttle nut 140 is coupled to the nozzle cover 114. More specifically, the throttle nut 140 is internally threaded for engagement with an externally threaded hollow post 144 at the lower end of the nozzle cover 114. Rotation of the throttle nut 140 causes it to move along the threading in an axial direction. In one preferred form, rotation of the throttle nut 140 in a counterclockwise direction advances the nut 140 towards the inlet 118 and away from the deflector 102. Conversely, rotation of the throttle nut 140 in a clockwise direction causes it to move away from the inlet 118. Although threaded surfaces are shown in the preferred embodiment, it is contemplated that other engagement surfaces could be used to effect axial movement.

In operation, a user may rotate the outer wall of the nozzle collar 138 in a clockwise or counterclockwise direction. As shown in FIGS. 3 and 4, the nozzle cover 114 preferably includes one or more cut-out portions to define one or more access windows to allow rotation of the nozzle collar outer wall. Further, as shown in FIG. 2, the nozzle collar 138, throttle nut 140, and nozzle cover 114 are oriented and spaced to allow the throttle nut 140 to essentially block fluid flow through the inlet 118 or to allow a desired amount of fluid flow through the inlet 118. As can be seen in FIG. 4, the throttle nut 140 preferably has a helical bottom surface 146 for engagement with a corresponding helical surface 148 of a valve seat 150 when fully extended.

Rotation in a counterclockwise direction results in axial movement of the throttle nut 140 toward the inlet 118. Continued rotation results in the throttle nut 140 advancing to the valve seat 150 formed at the inlet 118 for blocking fluid flow. The dimensions of radial tabs 152, 154 of the throttle nut 140 and the splined internal surface 142 of the nozzle collar 138 are preferably selected to provide over-rotation protection. More specifically, the radial tabs 152, 154 are sufficiently flexible such that they slip out of the splined recesses 142 upon over-rotation. Once the inlet 118 is blocked, further rotation of the nozzle collar 138 causes slippage of the radial tabs 152, 154, allowing the collar 138 to continue to rotate without corresponding rotation of the throttle nut 140, which might otherwise cause potential damage to sprinkler components.

Rotation in a clockwise direction causes the throttle nut 140 to move axially away from the inlet 118. Continued rotation allows an increasing amount of fluid flow through the inlet 118, and the nozzle collar 138 may be rotated to the desired amount of fluid flow. When the valve is open, fluid flows through the nozzle 100 along the following flow path: through the inlet 118, between the nozzle collar 138 and the throttle nut 140 and through valve 132, between ribs 156 of the nozzle cover 114, through the arcuate opening 108 (if set to an angle greater than 0 degrees), upwardly along the upper cylindrical wall of the nozzle cover 114, to the underside surface of the deflector 102, and radially outwardly from the deflector 102. It should be evident that the direction of rotation of the outer wall for axial movement of the throttle nut 140 can be easily reversed, i.e., from clockwise to counterclockwise or vice versa.

Figure 5:
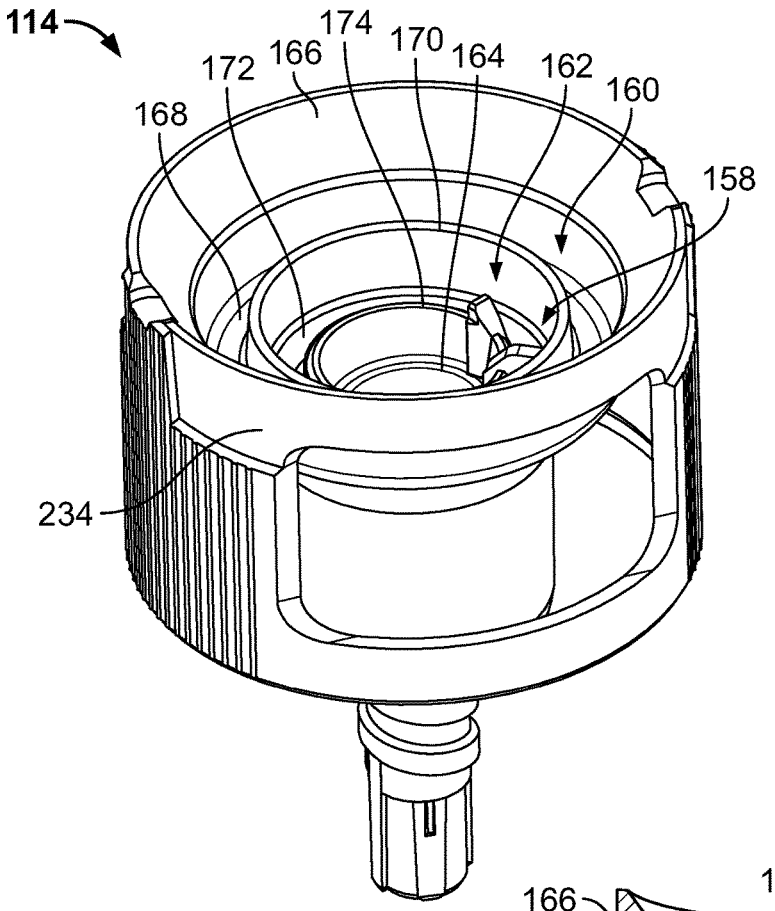
FIG. 5 is a top perspective view of the nozzle cover of the nozzle of FIG. 1.
Figure 6:
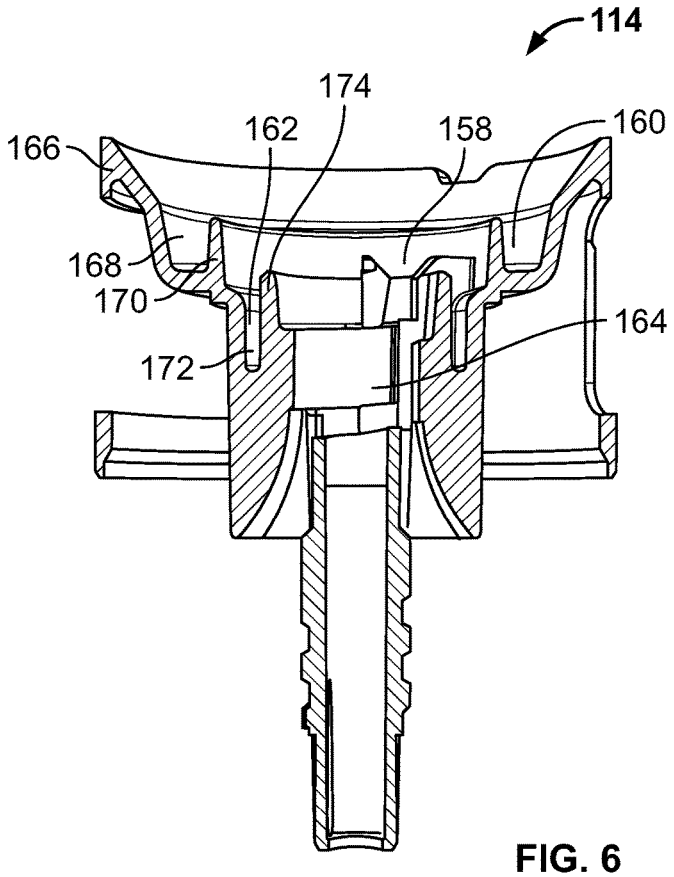
FIG. 6 is a cross-sectional view of the nozzle cover of the nozzle of FIG. 1.

The nozzle 100 may also include features to prevent grit and other debris from entering into sensitive areas of the nozzle 100, which may affect or even prevent operation of the nozzle 100. For example, as shown in FIGS. 5 and 6, an upward facing surface 158 of the nozzle cover 114 includes two "debris traps" 160, 162 that limit debris from becoming lodged in the central hub 164 of the nozzle cover 114. As can be seen, this central hub 164 of the nozzle cover 114 defines a recess for the nesting insertion of the valve sleeve 106, and the nozzle cover 114 and valve sleeve 106 are the two valve bodies that define the arc adjustment valve 104. Accordingly, if debris becomes lodged in the central hub 164 of the nozzle cover 114, it may interfere with rotation of the valve sleeve 106, may block a portion of the arcuate valve 104, or may affect sealing between the valve bodies 106, 114 (e.g., the closed portion of the valve 104). In one form, without debris traps 160, 162, the back flow of grit, debris, or other particulate matter into the nozzle cover 114 may result in such debris being sucked into the central hub 164 and/or valve sleeve 106.

The first debris trap 160 is defined, in part, by the outer wall 166 of the nozzle cover 114. As can be seen, the outer wall 166 is inclined at an angle such that the outermost portion is at a higher elevation than the innermost portion. During normal operation, when grit, dirt, or other debris comes into contact with this outer wall 166, it may be guided into a first channel (or first annular depression) 168. The debris is prevented from moving from this first channel 168 and entering the central hub 164 by an intermediate wall 170. In other words, the debris trap 160 is defined, in part, by the outer wall 166, first channel 168, and intermediate wall 170 such that debris is trapped in the first channel 168. As shown in FIGS. 5 and 6, the second debris trap 162 includes a second channel 172 (or second annular depression) disposed between the intermediate wall 170 and an inner wall 174. In other words, the debris traps 160, 162 may include two separate annular channels 168, 172, respectively, for capturing debris before it enters the central hub 164.

As stated, one way in which debris may accumulate is from back flow or back siphoning when water stops flowing through the nozzle 100 (i.e., the sprinkler is turned off). One purpose of the debris traps 160, 162 is to block this back flow or back siphoning from depositing debris in the central hub 164 of the nozzle cover 114 and/or valve sleeve 106 so as to possibly interfere with the arc adjustment operation. As is evident, nozzles 100 are subject to external contaminants during operation. Adding walls/barriers and channels to trap and prevent debris from reaching the arc valve portion of the nozzle 100 helps ensure effective operation of the nozzle 100.

In addition, in one form, the nozzle 100 may be mounted in a "pop-up" sprinkler assembly 200. One example of such a pop-up sprinkler assembly 200 is shown in FIGS. 7 and 8. The pop-up sprinkler assembly 200 described and shown herein is one exemplary type of assembly that may be used with the nozzle 100. The assembly 200 and many of its components are similar to that shown and described in U.S. Pat. Nos. 6,997,393 and 8,833,672, which have been assigned to the assignee of the present application and which are incorporated by reference herein in their entirety. Other similar types of pop-up sprinklers and components are shown and described in U.S. Pat. Nos. 4,479,611 and 4,913,352, which also have been assigned to the assignee of the present application and which are also incorporated by reference herein in their entirety. As should be evident, various other types of sprinkler assemblies also may incorporate nozzle 100.

As shown in FIGS. 7 and 8, the sprinkler assembly 200 generally includes a housing 202 and a riser assembly 204. The riser assembly 204 travels cyclically between a spring-retracted position and an elevated spraying position in response to water pressure. More specifically, when the supply water is on, i.e., pressurized for a watering cycle, the riser assembly 204 extends ("pops up") above ground level so that water can be distributed to the terrain for irrigation. When the water is shut off at the end of a watering cycle, the riser assembly 204 retracts into the housing 202 where it is protected from damage. FIGS. 7 and 8 show the riser assembly 204 in a retracted position.

The housing 202 provides a protective covering for the riser assembly 204 and, together with the riser assembly 204, serves as a conduit for incoming water under pressure. The housing 202 preferably has a generally cylindrical shape and is preferably made of a sturdy lightweight injection molded plastic or similar material, suitable for underground installation with the upper end 206 disposed substantially flush with the surface of the soil. The housing 202 preferably has a lower end 208 with an inlet 210 that is threaded to connect to a correspondingly threaded outlet of a water supply pipe (not shown).

In one preferred form, the riser assembly 204 includes a stem 212 with a lower end 214 and an upper end, or nozzle mounting portion, 216. The stem 212 is preferably cylindrical in shape and is preferably made of a lightweight molded plastic or similar material. The riser assembly 204 has a threaded upper end 218 for attaching to the nozzle 100. The nozzle 100 ejects water outwardly from the sprinkler 200 when the riser assembly 204 is in the elevated spray position.

A spring 220 for retracting the riser assembly 204 is preferably disposed in the housing 202 about the outside surface 222 of the stem 212. The spring 220 has a bottom coil 224 that engages a guide 226 and an upper coil 228 seated against the inside of a housing cover 230. The spring 220 biases the riser assembly 204 toward the retracted position until the water pressure reaches a predetermined threshold pressure. An example of a threshold pressure is about 5 psi, at which time the water supply pressure acting on riser assembly 204 would be sufficient to overcome the force of the spring 220 and cause movement of the riser assembly 204 to the elevated spraying position.

The housing cover 230 serves to minimize the introduction of dirt and other debris into the housing 202. The housing cover 230 preferably has internal threads and is mounted to the upper end 206 of the housing 202 which has corresponding threads. The cover 230 has a central opening through which the elongated riser assembly 204 is movable between the retracted position and the elevated spraying position. The housing cover 230 is also preferably fitted with a seal 232, preferably a wiper seal, mounted on the inside of the cover 230.

In one form, the nozzle cover 114 has a reduced outer diameter that forms another sort of debris prevention feature. More specifically, as can be seen in FIG. 5, the nozzle cover 114 includes a reduced diameter portion 234 (or indented portion) near the top of the nozzle cover 114. As can be seen from FIG. 8, this reduced diameter portion 234 increases the gap 236 between the nozzle cover 114 and the seal 232, thereby creating a larger flow path around the nozzle 100.

The nozzle 100 is exposed to external contaminants during operation. It is believed that reducing the outside diameter of the nozzle cover 114 creates an alternative path for the back flow of water and debris. Adding an alternative reverse flow path reduces the likelihood of debris flowing into the nozzle 100 and reaching the arc valve portion of the nozzle 100.

Figure 9:
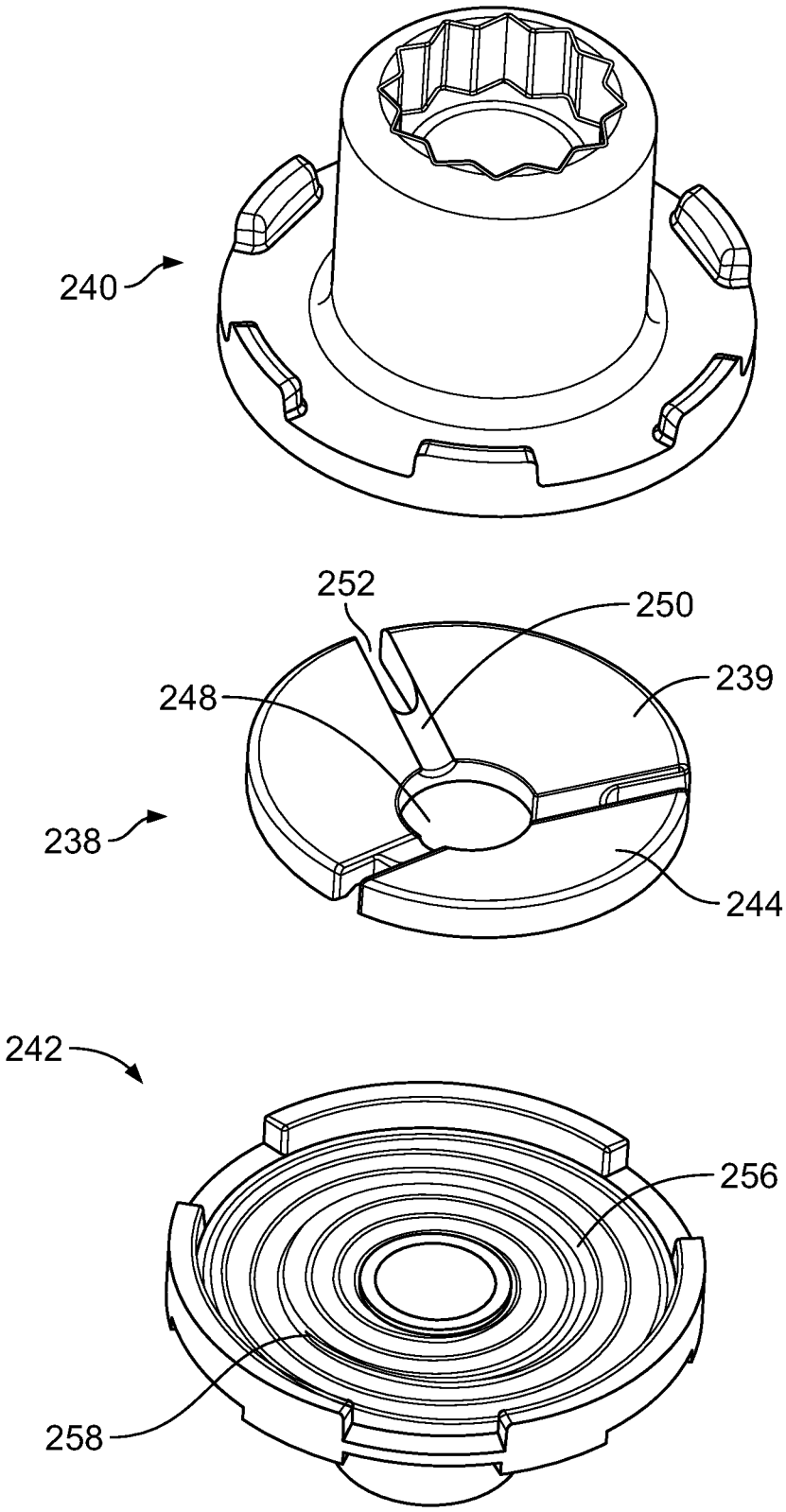
FIG. 9 is a top perspective view of the friction disk, brake pad, and seal retainer of the nozzle of FIG. 1.
Figure 10:
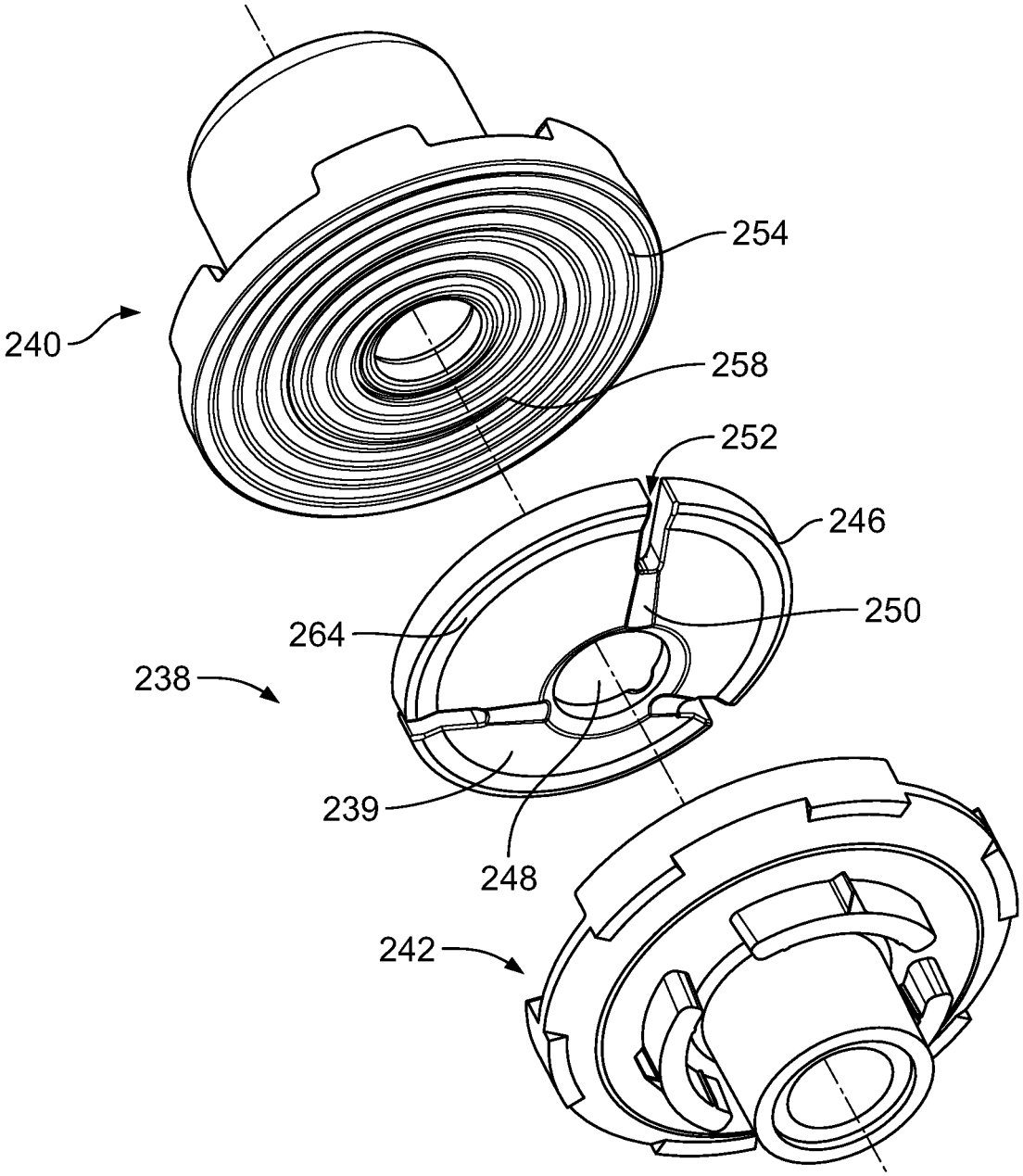
FIG. 10 is a bottom perspective view of the friction disk, brake pad, and seal retainer of the nozzle of FIG. 1.
Figure 11:
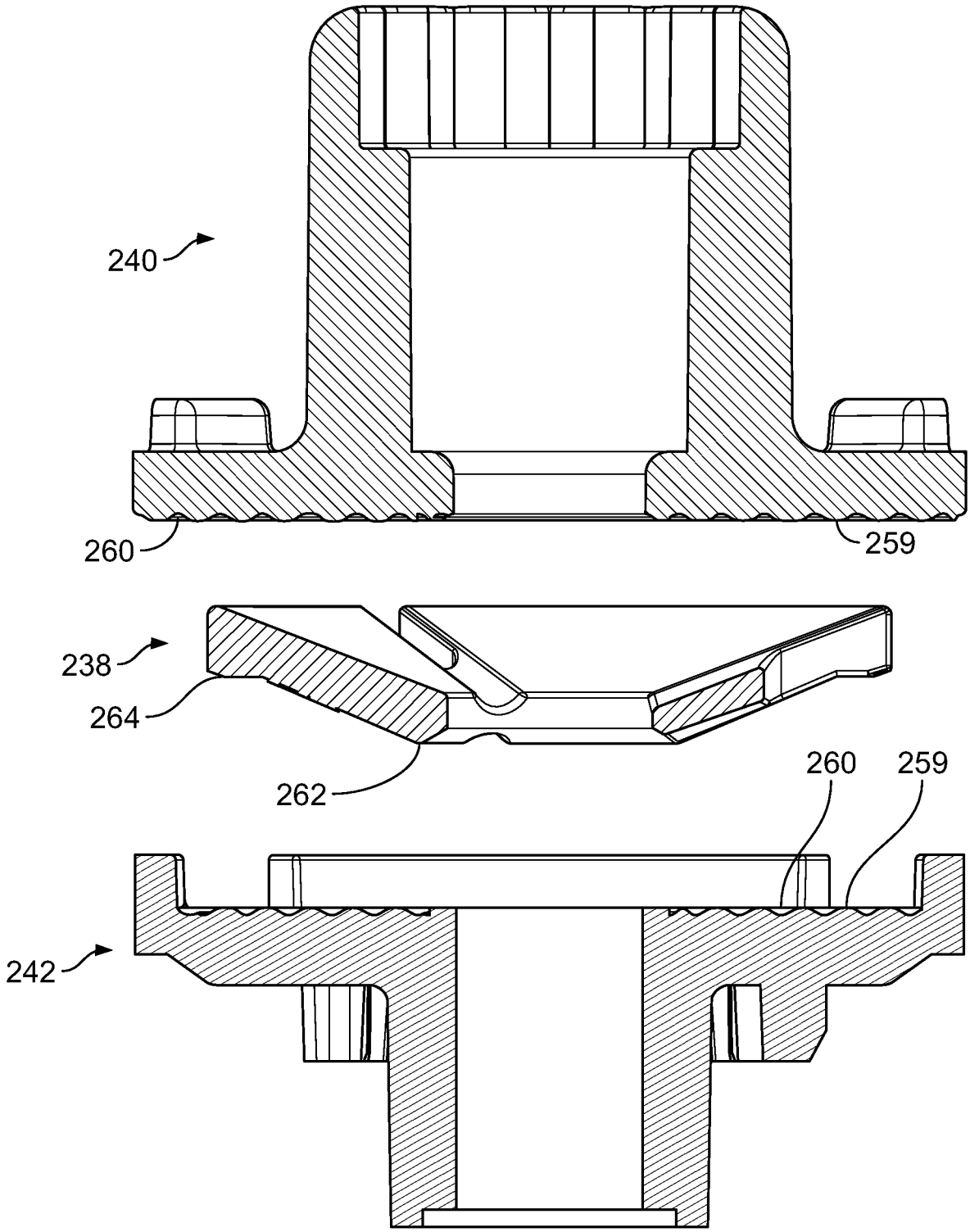
FIG. 11 is a cross-sectional view of the friction disk, brake pad, and seal retainer of the nozzle of FIG. 1.
Figure 13:
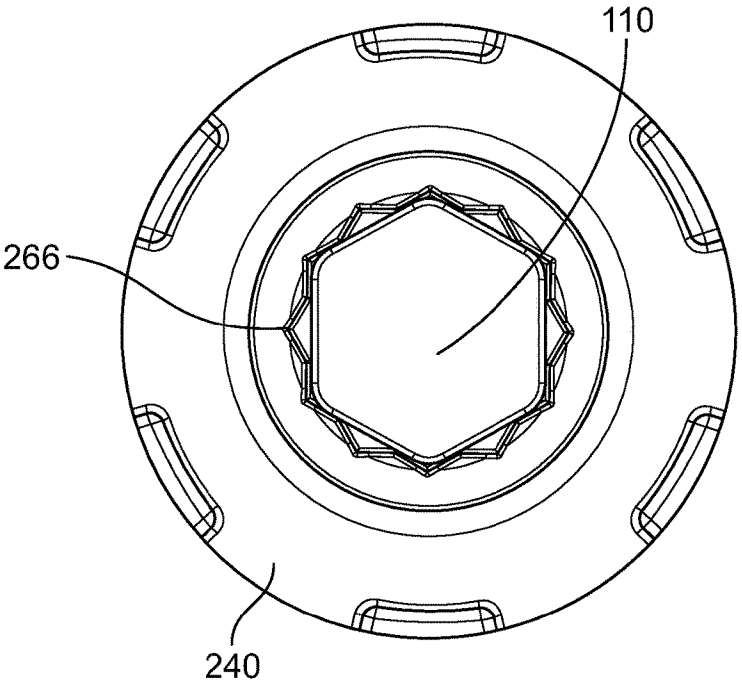
FIG. 13 is a top plan view of the shaft within the friction disk of the nozzle of FIG. 1.

Further, the nozzle 100 includes braking features to maintain relatively consistent braking under various conditions. As can be seen in FIGS. 9-11, nozzle 100 includes a frustoconical brake pad 238. The brake pad 238 is part of a brake disposed in the deflector 102, which maintains the rotation of the deflector 102 at a relatively constant speed irrespective of flow rate, fluid pressure, and temperature. The brake includes the brake pad 238 sandwiched between a friction disk 240 (above the brake pad 238) and a seal retainer 242 (below the brake pad 238). During operation of the nozzle 100, the friction disk 240 is held relatively stationary by the shaft 110, the seal retainer 242 rotates with the deflector 102 at a first rate, and the brake pad 238 rotates at a second, intermediate rate. Further, during operation, the seal retainer 242 is urged upwardly against the brake pad 238, which results in a variable frictional resistance that maintains a relatively constant rotational speed of the deflector 102 irrespective of the rate of fluid flow, fluid pressure, and/or operating temperature.

As can be seen in FIGS. 9-11, the brake pad 238 is generally frustoconical in shape and includes a top surface 244 and a bottom surface 246. The frustoconical shape is inverted as shown in the figures and includes a central bore 248 for insertion of the shaft 110. The top and bottom surfaces 244, 246 each include three radial grooves 250 spaced equidistantly about the surfaces and preferably having a uniform width. These radial grooves 250 extend radially outwardly from the central bore 248 about halfway to the outer perimeter. These grooves 250 help distribute lubrication (or grease) over the surface of the brake pad 238.

The brake pad 238 also includes a feature that allows it to provide sufficient braking at low power input. More specifically, as can be seen in FIGS. 9 and 10, the brake pad 238 includes three radially extending slots 252 that continue outwardly in the direction of the three radial grooves 250. In other words, each radial groove 250 terminates in a radial slot 252. It has been found that these three radial slots 252 allow the brake pad 238 to act like three separate, cantilevered brake pad bodies and make the brake pad 238 less stiff. This design allows part of the brake pad 238 to begin to flatten at lower loads than previous designs. More specifically, at low power input, a conical design without the slots 252 may not tend to collapse (or flatten) enough to cause sufficient braking, so the deflector 102 may be rotating too fast. In contrast, the outer annular portion 239 of the split brake pad 238 defined by the slots 252 tends to flatten easier and the brake pad 238 stiffness is reduced, thereby causing braking sooner at low power input.

The brake includes another feature intended to help distribute lubrication (or grease) more uniformly over the top and bottom surfaces 244, 246 of the brake pad 238. The friction disk 240 and seal retainer 242 each include raised spiral surfaces that engage and interact with the brake pad 238. More specifically, the bottom of the friction disk 240 defines a first, raised spiral surface 254 that engages the top surface 244 of the brake pad 238, and the top of the seal retainer 242 defines a second, raised spiral surface 256 that engages the bottom surface 246 of the brake pad 238. Depending on the orientation of the spiral surfaces 254, 256, i.e., clockwise or counterclockwise, and the direction of rotation of the deflector 102, these spiral surfaces 254, 256 have been found to help distribute grease deposited at inner or outer margins of the spiral pattern to the rest of the spiral pattern.

Further, in one form, each spiraled surface 254, 256 is preferably a "double spiraled surface" that initially spirals in a first direction, i.e., clockwise, as the spiral moves inwardly, and then, near a halfway transition point 258, spirals in the reverse direction, i.e., counter-clockwise, as the spiral continues to move inwardly. The grease is initially deposited as several dots near the middle of the double spiraled pattern, and during rotation of the deflector 102, it is distributed both inwardly and outwardly toward both the inner and outer margins. This double spiraled surface tends to distribute lubricant uniformly to both the inner and outer portions of the brake pad 238.

The brake pad 238 is preferably formed from a rubber material and coated with a lubricant, such as a thin layer of a selected grease, to provide a relatively controlled coefficient of friction. The spiraled surfaces 254, 256 help distribute the lubricant over the entire top and bottom faces of the brake pad 238. By ensuring more uniform lubrication, the spiraled surfaces 254, 256 assist with proper braking at both low and high power input. The power input is determined generally by fluid pressure and flow rate and corresponds generally to the rotational torque directed against the deflector 102 by the impacting fluid.

The spiraled surfaces 254, 256 define crests 259 and troughs 260 with troughs 260 acting as reservoirs for receiving lubricant. More specifically, the troughs 260 act as reservoirs for the lubricant to help ensure a minimum grease film thickness. Without the spiraled surfaces 254, 256 (i.e., the surfaces are flat), the grease film thickness can approach zero, and it has been found that this minute thickness can result in excessive braking, especially for high power input. In contrast, it is believed that the spiraled surfaces 254, 256 provide a higher minimum thickness. The minimum grease film thickness will generally be on the order of (or slightly less than) the distance between the crests 259 and troughs 260 of the spiraled surfaces 254, 256.

Thus, at very low power input, the brake pad 238 generally retains its conical shape, and the seal retainer 242 is urged slightly upwardly against the bottom surface 246 of the brake pad 238. The seal retainer 242 engages the brake pad 238 at a relatively thin inner annular portion 262 of the brake pad 238 and provides relatively little braking at very low power input. As the power input increases slightly, the three radial slots 252 in the brake pad 238 cause the outer annular portion 239 of the brake pad 238 to flatten such that more surface area is in engagement, friction increases, and braking increases.

In addition, the reverse spiral surfaces 254, 256 provide relatively uniform lubrication of the brake pad 238 to make sure that the friction does not become excessive at high power input. At high power input, when there is significant frictional engagement between the brake pad 238 and other braking components, there may be too much braking, which may lead the nozzle 100 to stall. In other words, without sufficient grease thickness, the brake pad 238 may tend to cause too much friction at high power input.

At high power input, the thick outermost annular lip 264 is sandwiched between the friction disk 240 and seal retainer 242, and most of the friction (and braking) results from the engagement of the thick outer lip 264 with the seal retainer 242. However, as addressed, it has been found that there is more braking at high power input than would be anticipated, and it is believed that this excessive braking may result from a change in grease thickness at high power input. More specifically, it is believed that the grease viscosity may be reduced (i.e., the grease becomes spread too thin) at high power input, resulting in too much friction, too much braking, and an overly reduced deflector rotational speed.

The spiraled surfaces 254, 256 on the friction disk 240 and seal retainer 242 assist in avoiding excessive braking at high power input. More specifically, the troughs 260 form a reservoir for the grease, so as to limit the minimum film thickness of the grease with the minimum film thickness being generally about the distance between a crest 259 and a trough 260. It is believed that this minimum film thickness increases lubrication and thereby limits the excessive braking and unexpected slowing of the deflector 102 at high power input.

Figure 12:
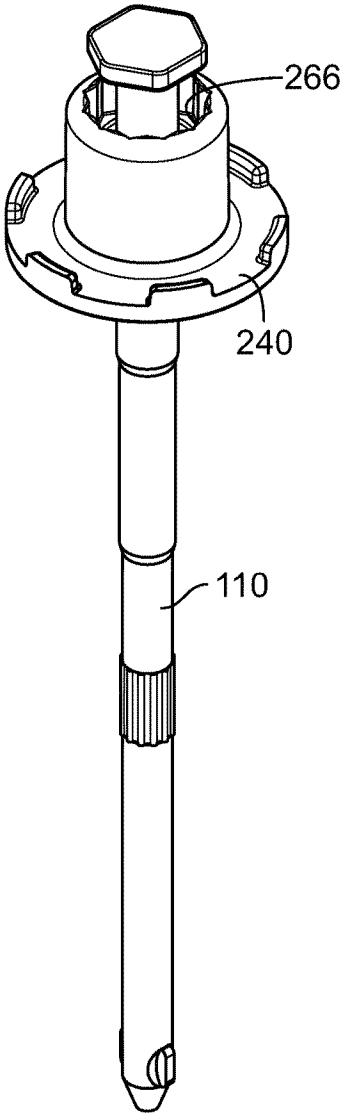
FIG. 12 is a top perspective view of the shaft within the friction disk of the nozzle of FIG. 1.

As shown in FIG. 12, the friction disk 240 includes another feature that helps with adjustment of the arc adjustment valve 104. More specifically, an inner diameter 266 of the friction disk 240 is in the form of a twelve-pointed star, or twenty four sided polygon. The inner diameter 266 of the friction disk 240 cooperates with the shaft 110 during arc adjustment. As shown in FIG. 12, the six-sided (hexagonal) top of the shaft 110 is seated within the twelve-pointed recess defined by the inner diameter 266.

It has been found that the twelve-pointed star arrangement assists with indexing of the six-pointed shaft 110 during manufacturing and assembly. In other words, it helps align the friction disk 240 with the shaft 110 during assembly. Also, following assembly and during operation, the twelve-pointed star arrangement may help with alignment of these two components. If, for some reason, the top of the friction disk 240 and the top of the shaft 110 become out of engagement during operation, this arrangement helps with realignment by providing more positions for realignment. In other words, by increasing the friction disk inside diameter 266 from six points to twelve points, the likelihood of indexing to the shaft six-point shape is increased.

Figure 14:
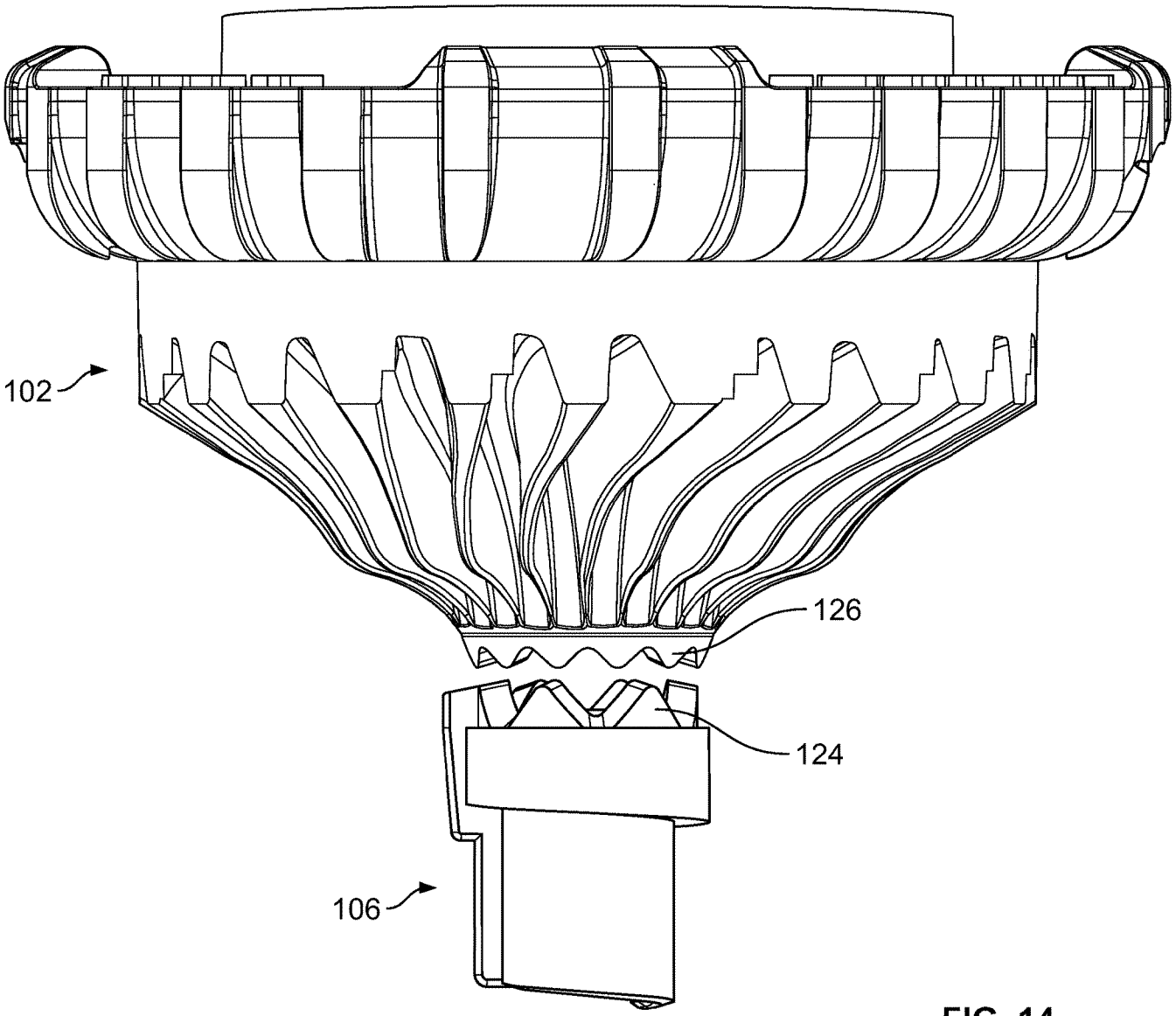
FIG. 14 is a side perspective view of the deflector and the valve sleeve of the nozzle of FIG. 1.

As shown in FIG. 14, the deflector 102 and valve sleeve 106 include an engagement feature that helps with arc adjustment. More specifically, the deflector 102 includes twelve downwardly-facing teeth 126 that engage six upwardly-facing teeth 124 of the valve sleeve 106. As can be seen, the number and arrangement of teeth are mismatched. Also, the twelve downwardly-facing teeth 126 of the deflector 102 are shallower (shorter in height) than the six upwardly-facing teeth 124 of the valve sleeve 106. With these shallower deflector teeth 126, the distance between the deflector teeth 126 and the valve sleeve teeth 124 can be reduced. In other words, the deflector 102 need not travel as far (i.e., need not be pushed down as far by a user) so that the teeth engage one another to adjust the arcuate setting.

This arrangement reduces the required lift to disengage the teeth 124, 126 from one another. This reduced lift may be desirable when the force exerted by upwardly directed water to lift the deflector 102 is limited (such as under low water flow conditions). Otherwise, under such conditions, the deflector 102 may not have sufficient clearance to rotate without interference by the teeth 124, 126 with one another. Also, the tips of the deflector and/or valve teeth 124, 126 may be truncated to provide additional clearance.

Further, it has been found that this engagement feature helps prevent the accumulation of debris and other particulate matter on and about the valve sleeve 106. The presence of debris or particulates in the engagement feature (i.e., teeth 124, 126) can lead to damage to the deflector 102 or valve sleeve 106 when engaged. When a user depresses the deflector 102 to cause the corresponding teeth to engage, it can be seen that a gap (or a void) will be formed between the teeth 124, 126. In other words, because the deflector teeth 126 are shallower than the valve sleeve teeth 124, the deflector teeth 126 will not completely fill the troughs between adjacent valve sleeve teeth 124 during engagement. The void between engaging teeth 124, 126 creates a relief for debris to occupy during engagement, thereby improving debris tolerance.

Figure 15:
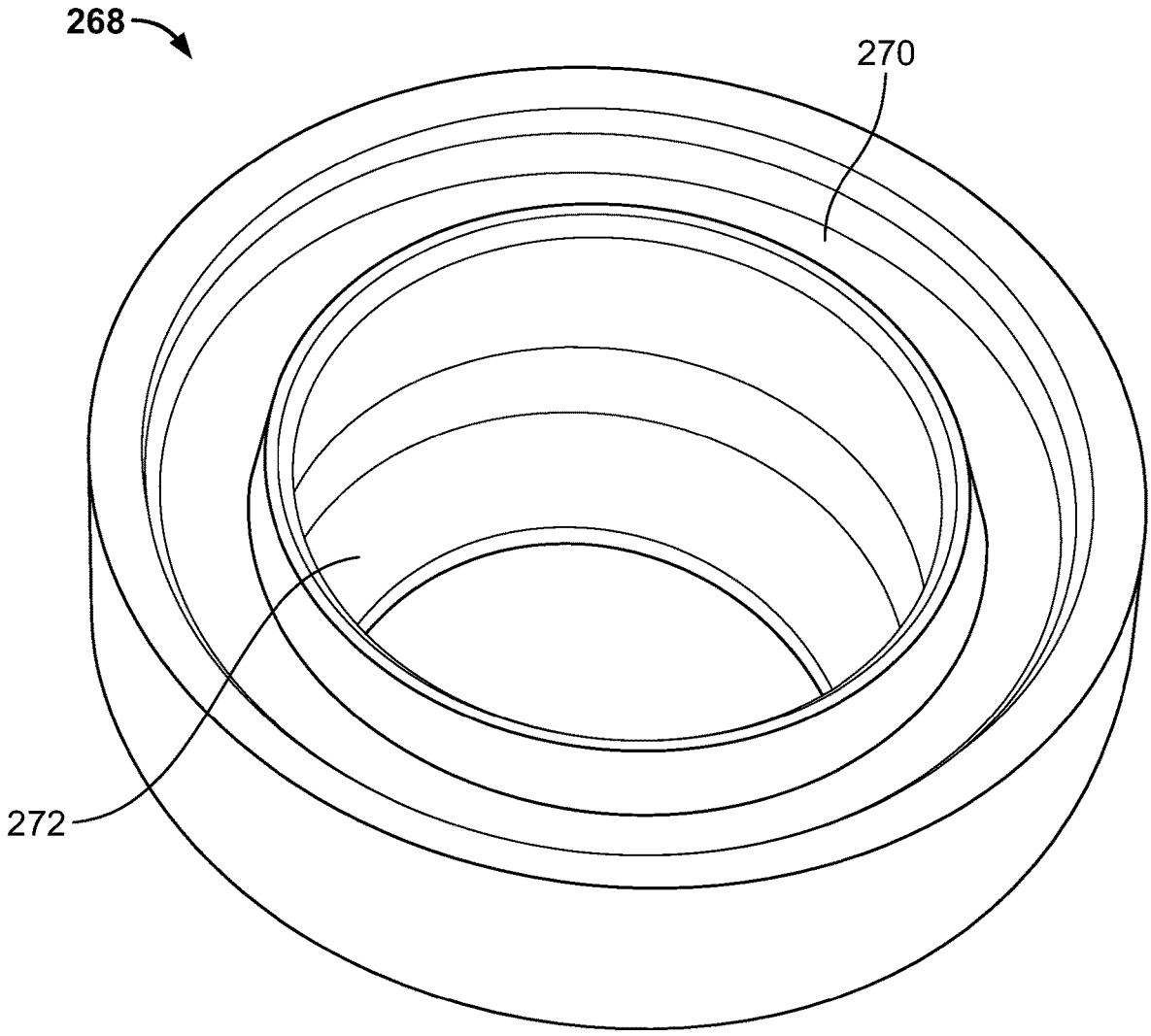
FIG. 15 is a top perspective view of a deflector lip seal of the nozzle of FIG. 1.
Figure 16:
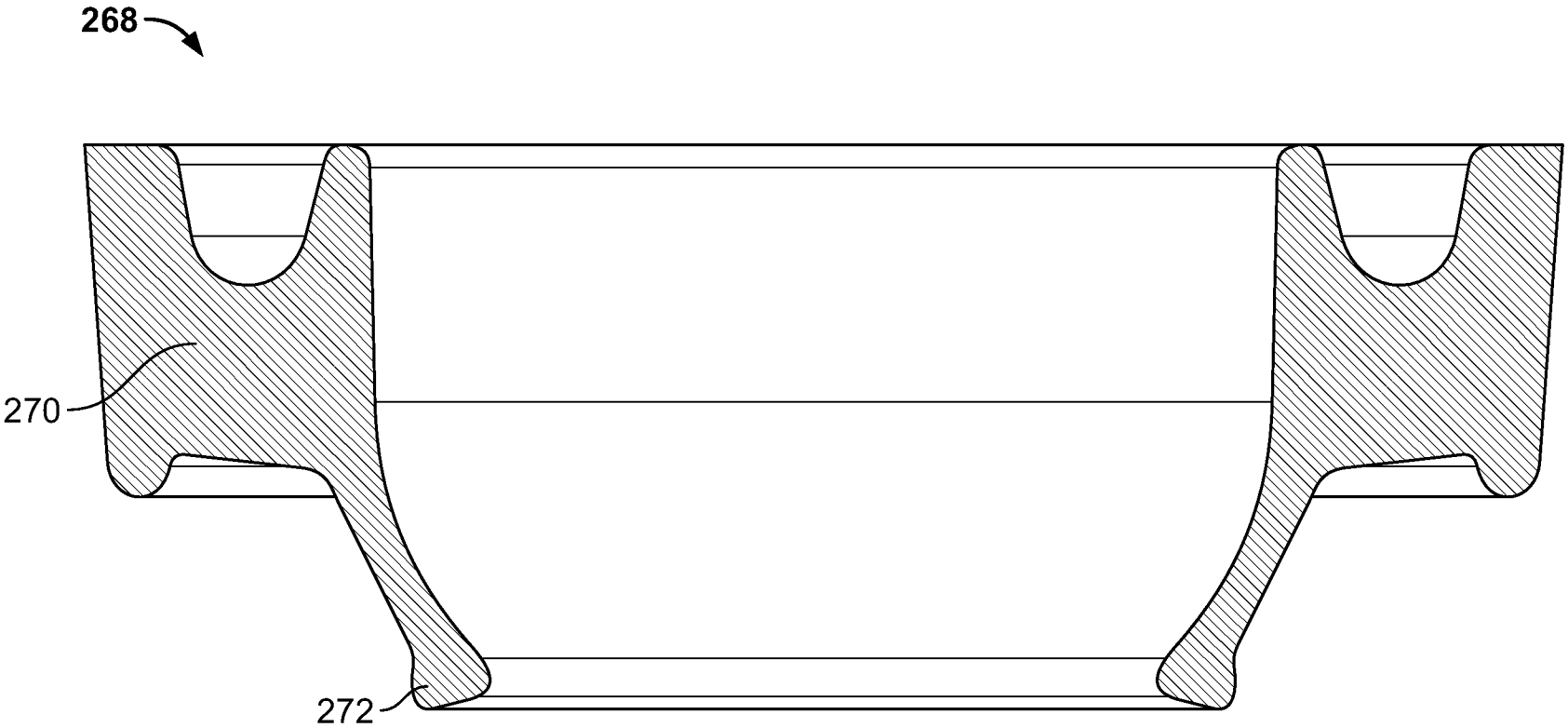
FIG. 16 is a cross-sectional view of the deflector lip seal of FIG. 15.
Figure 17:
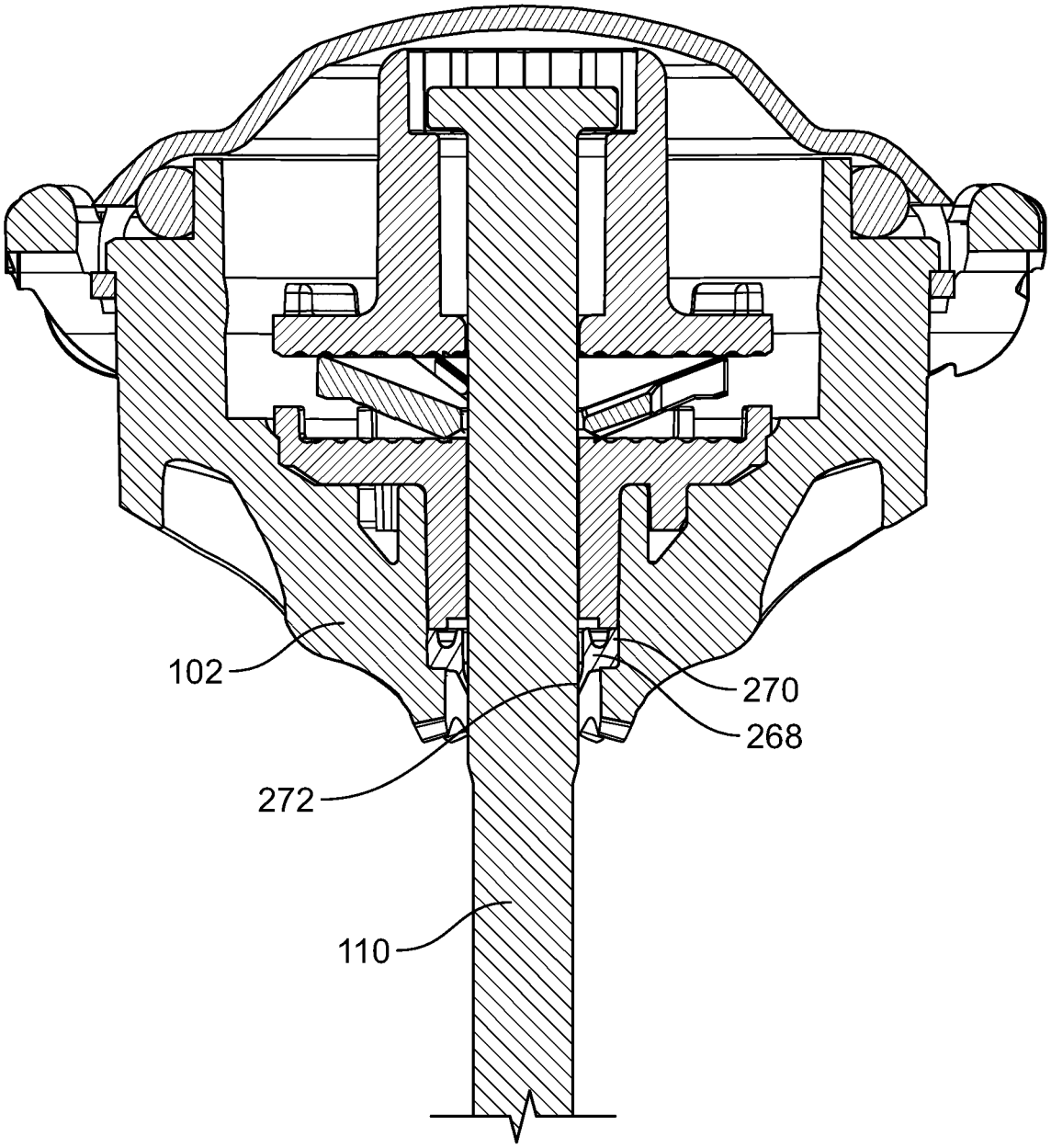
FIG. 17 is a partial cross-sectional view of the nozzle of FIG. 1.

As shown in FIGS. 15-17, the nozzle 100 includes a seal feature that helps limit excessive friction as the deflector 102 is rotating during irrigation. More specifically, as shown in FIGS. 15 and 16, the nozzle 100 includes a single lip deflector seal 268 that seals the interior of the deflector 102 from upwardly-directed fluid while also minimizing the amount of friction during deflector rotation. The seal 268 includes an annular top portion 270 that is mounted near the bottom end of the deflector 102, which causes the seal 268 to rotate with the deflector 102. The seal 268 further includes an inwardly extending lip 272 that blocks water directed upwardly through the nozzle 100 from the interior of the deflector 102. Thus, the seal 268 keeps water and debris from entering the brake/speed control assembly.

The seal 268 is designed so that only a small portion of the seal 268 comes into contact with the shaft 110 during irrigation. As can be seen, the lip 272 has a smaller inner diameter than the annular top portion 270 so that only the lip 272 circumferentially engages the shaft 110. During irrigation, the seal 268 is rotating with the deflector 102, and contact by the seal with the stationary shaft 110 results in friction. A portion of the lip 272 comes into contact with the shaft 110 in order to seal against the shaft 110, but this portion is minimized in order to reduce the amount of friction caused by the seal 268. If the friction is excessive, this may interfere with the operation of the deflector 102 and with the brake, especially at low power input settings where seal friction may have a proportionately large impact on the relatively slow rotation of the deflector 102. In addition, the lip 272 provides an effective seal because it fits snugly about the entire circumference of the shaft 110 (i.e., there is good interference with the shaft 110). This circumferential arrangement also helps the seal 268 resist opening a gap due to side load forces acting against the deflector 102.

It will be understood that various changes in the details, materials, and arrangements of parts and components which have been herein described and illustrated in order to explain the nature of the nozzle may be made by those skilled in the art within the principle and scope of the subject matter as expressed in the appended claims. Furthermore, while various features have been described with regard to a particular embodiment or a particular approach, it will be appreciated that features described for one embodiment also may be incorporated with the other described embodiments.

What is claimed is:

1. A nozzle comprising:

a rotatable deflector having an underside surface contoured to deliver fluid radially outwardly therefrom;

a nozzle body defining an inlet and an outlet, the inlet configured to receive fluid from a source and the outlet configured to deliver fluid to the underside surface of the deflector to cause rotation of the deflector;

a brake disposed within the deflector configured to reduce the rotational speed of the deflector, the brake comprising a first brake body that rotates with the deflector, a second brake body that is fixed against the rotation, and a brake pad disposed between and engaging the first brake body and the second brake body;

wherein at least one of the first brake body and the second brake body includes a spiral surface configured to distribute lubricant on a surface of the brake pad.

2. The nozzle of claim 1, wherein the first brake body includes a first spiral surface configured to distribute lubricant on a first surface of the brake pad.

3. The nozzle of claim 2, wherein the second brake body includes a second spiral surface configured to distribute lubricant on a second surface of the brake pad.

4. The nozzle of claim 3, wherein the first surface of the brake pad is a bottom surface and the second surface of the brake pad is a top surface, the first brake body engaging the bottom surface of the brake pad and the second brake body engaging the top surface of the brake pad.

5. The nozzle of claim 1, wherein the spiral surface is a double spiral surface that initially spirals in a first direction as one moves inwardly from an outer circumference of the at least one of the first brake body and the second brake body and that then spirals in a second, reverse direction as one continues to move inwardly toward a center of the at least one of the first brake body and the second brake body.

6. The nozzle of claim 1, wherein the brake pad includes at least one slot extending entirely through the brake pad, the at least one slot configured to cause the brake pad to flatten when the deflector is rotating.

7. A nozzle comprising:

a deflector having an underside surface contoured to deliver fluid radially outwardly therefrom;

a nozzle body defining an inlet and an outlet, the inlet configured to receive fluid from a fluid source and the outlet configured to deliver fluid to the underside surface of the deflector, the outlet configured to direct fluid against the underside surface of the deflector for the redirection of fluid radially outwardly from the deflector within a predetermined coverage area;

an outer debris trap in the nozzle body disposed about the outlet and comprising a first wall and a second wall defining an outer channel therebetween, the outer debris trap disposed radially outwardly from the outlet and configured to limit debris from flowing into the outlet; and a mounting portion configured to mount the nozzle to the fluid source, the mounting portion being disposed upstream of the outer debris trap and downstream of the inlet;

wherein the outer debris trap is spaced radially outwardly from the outlet such that neither the first wall nor the second wall defines a portion of the outlet.

8. The nozzle of claim 7, wherein the nozzle body includes a third wall, the second and third walls defining an inner channel therebetween and constituting an inner debris trap.

9. The nozzle of claim 8, wherein the outer debris trap is disposed radially outwardly from the inner debris trap.

10. The nozzle of claim 8, wherein the first wall has a greater axial height than the second wall, and the second wall has a greater axial height than the third wall.

11. The nozzle of claim 8, wherein the outer debris trap has a first bottom and the inner debris trap has a second bottom, the second bottom being upstream of the first bottom.

12. The nozzle of claim 8, wherein the first, second, and third walls are annular in cross-section and define annular inner and outer channels.

13. The nozzle of claim 7, further comprising an arc adjustment valve being adjustable to change an arcuate opening defining the outlet for directing fluid against the underside surface of the deflector for the redirection of fluid radially outwardly from the deflector within a predetermined arcuate coverage area, the arc adjustment valve having a first valve body and a second valve body configured to adjust the arcuate opening.

14. The nozzle of claim 7, wherein the first wall has an outer portion inclined at an angle such that a first, outermost portion is at a higher elevation than a second, innermost portion.

15. The nozzle of claim 7, wherein the mounting portion includes threading for engaging and mounting the nozzle to the fluid source.

16. A nozzle comprising:

a deflector having an underside surface contoured to deliver fluid radially outwardly therefrom;

a nozzle body defining an inlet and an outlet, the inlet configured to receive fluid from a fluid source and the outlet configured to deliver fluid to the underside surface of the deflector, the outlet configured to direct fluid against the underside surface of the deflector for the redirection of fluid radially outwardly from the deflector within a predetermined coverage area;

an inner debris trap in the nozzle body disposed about the outlet and comprising a first wall and a second wall defining an inner channel therebetween, the inner debris trap disposed radially outwardly from the outlet and configured to limit debris from flowing into the outlet; and wherein the inner channel of the inner debris trap includes a bottom surface between the first and second walls, the bottom surface being configured such that the inner channel is of constant depth along the entire inner debris trap;

wherein the first wall defines a portion of the outlet such that the inner debris trap is adjacent the outlet.

17. The nozzle of claim 16, wherein the nozzle body includes a third wall, the second and third walls defining an outer channel therebetween and constituting an outer debris trap, the outer debris trap being disposed radially outwardly from the inner debris trap.

18. The nozzle of claim 17, wherein the first, second, and third walls are annular in cross-section and define annular inner and outer channels.

* * * * *